US006257332B1

(12) United States Patent
Vidrine et al.

(10) Patent No.: US 6,257,332 B1
(45) Date of Patent: Jul. 10, 2001

(54) WELL MANAGEMENT SYSTEM

(75) Inventors: William L. Vidrine; Michael Feechan, both of Katy, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 09/396,406

(22) Filed: Sep. 14, 1999

(51) Int. Cl.[7] ..... E21B 44/00
(52) U.S. Cl. ..... 166/250.15; 166/373; 166/53
(58) Field of Search ..... 166/250.15, 373, 166/53, 65.1, 66.7, 77.2, 313

(56) References Cited

U.S. PATENT DOCUMENTS

| | | | |
|---|---|---|---|
| 4,256,146 | 3/1981 | Gemini et al. | 138/111 |
| 4,336,415 | 6/1982 | Walling | 174/47 |
| 4,463,814 | 8/1984 | Horstmeyer et al. | 174/45 |
| 4,636,934 | 1/1987 | Schwendemann et al. | 364/132 |
| 4,936,618 | 6/1990 | Sampa et al. | 294/86.31 |
| 5,018,583 | 5/1991 | Williams | 166/385 |
| 5,060,737 | 10/1991 | Mohn | 175/104 |
| 5,080,175 | 1/1992 | Williams | 166/385 |
| 5,097,870 | 3/1992 | Williams | 138/115 |
| 5,156,206 | 10/1992 | Cox | 166/242 |
| 5,172,765 | 12/1992 | Sas-Jaworsky et al. | 166/384 |
| 5,176,180 | 1/1993 | Williams et al. | 138/172 |
| 5,186,264 | 2/1993 | Du Chaffaut | 175/27 |
| 5,234,058 | 8/1993 | Sas-Jaworsky et al. | 166/385 |
| 5,285,008 | 2/1994 | Sas-Jaworsky et al. | 174/47 |
| 5,285,204 | 2/1994 | Sas-Jaworsky | 340/854.9 |
| 5,330,807 | 7/1994 | Williams | 428/34.5 |
| 5,348,096 | 9/1994 | Williams | 166/384 |

(List continued on next page.)

FOREIGN PATENT DOCUMENTS

| | | |
|---|---|---|
| 9712115 | 4/1997 | (WO) . |
| 9801651 | 1/1998 | (WO) . |
| 9905387 | 2/1999 | (WO) . |

OTHER PUBLICATIONS

Scrams™; *Surface–Controlled reservoir Analysis and Management System*; (Undated); (7 pages ).

S. Dunn–Norman; C. Robison; *Designing Well Completions for the Life of the Field*; (undated); (pp. 596–616).

S. Sangesland; Norwegian Institute of Technology, Trondheim; *Electric Submersible Pump for Subsea Completed Wells*; The Nordic Coun cil of Ministers Program for Petroleum Technology Nov. 26–27, 1991; (pp. 1–14).

A. Sas–Jaworsky and J. G. Williams; SPE 26536; *Development of Composite Coiled Tubing for Oilfield Services*; (undated); (pp. 150.

J. Leising, et al; SPE 37656; *Extending the reach of Coiled Tubing Drilling* (*Thrusters, Equalizers, and Tractors*); (1997) (pp. 1–14).

*Primary Examiner*—William Neuder
(74) *Attorney, Agent, or Firm*—Conley, Rose & Tayon, P.C.

(57) ABSTRACT

A system and method for managing a new well or an existing well. The system includes a sensor and a control disposed within a well, a surface control system at the surface, a continuous tubing string extending into the well, and a conductor disposed on the continuous tubing string. The conductor connects the sensor and control to the surface control system to allow the surface control system to monitor downhole conditions and to operate the control in response to the downhole conditions. Another conductor may also be provided along the continuous tubing string to conduct power from a surface power supply to the control. The conductors are preferably housed in the wall of the continuous tubing string and may be electrical conductors, optical fibers, and/or hydraulic conduits. The control is preferably equipped with a sensor that verifies operation and status of the device and provides the verification to the surface processor via the conductor. Contemplated controls include valves, sliding sleeves, chokes, filters, packers, plugs, and pumps. The system can be installed through the production tubing of an existing well.

66 Claims, 10 Drawing Sheets

U.S. PATENT DOCUMENTS

| | | | |
|---|---|---|---|
| 5,351,752 | 10/1994 | Wood et al. | 166/68 |
| 5,437,899 | 8/1995 | Quigley | 428/35.7 |
| 5,443,099 | 8/1995 | Chaussepied et al. | 138/109 |
| 5,469,916 | 11/1995 | Sas-Jaworsky et al. | 166/64 |
| 5,540,870 | 7/1996 | Quigley | 264/103 |
| 5,547,029 | 8/1996 | Rubbo et al. | 166/375 |
| 5,647,435 | 7/1997 | Owens et al. | 166/250 |
| 5,666,050 | 9/1997 | Bouldin et al. | 324/207 |
| 5,667,023 | 9/1997 | Harrell et al. | 175/45 |
| 5,706,892 | 1/1998 | Aeschbacher, Jr. et al. | 166/66 |
| 5,706,896 | 1/1998 | Tubel et al. | 166/313 |
| 5,721,538 | 2/1998 | Tubel et al. | 340/853.4 |
| 5,730,219 | 3/1998 | Tubel et al. | 66/250 |
| 5,732,776 | 3/1998 | Tubel et al. | 166/250 |
| 5,744,877 | 4/1998 | Owens | 307/103 |
| 5,769,160 | 6/1998 | Owens | 166/65.1 |
| 5,794,703 | 8/1998 | Newman et al. | 166/381 |
| 5,803,167 | 9/1998 | Bussear et al. | 166/65.1 |
| 5,808,192 | 9/1998 | Schmidt | 73/152.5 |
| 5,828,003 | 10/1998 | Thomeer et al. | 174/69 |
| 5,829,520 | 11/1998 | Johnson | 166/250 |
| 5,868,201 | 2/1999 | Bussear et al. | 166/53 |
| 5,896,928 | 4/1999 | Coon | 166/373 |
| 5,906,238 | 5/1999 | Carmody et al. | 166/53 |
| 5,908,049 | 6/1999 | Williams et al. | 138/125 |
| 5,913,337 | 6/1999 | Williams et al. | 138/125 |
| 5,920,032 | 7/1999 | Aeschbacher et al. | 174/47 |
| 5,921,285 | 7/1999 | Quigley et al. | 138/125 |
| 6,026,911 | 2/2000 | Angle et al. | 175/24 |

38,40
10
37
36
41
39
20
12
22
42
30
78
18
28
30
32
26
14
16
24
28

WELL MANAGEMENT SYSTEM

BACKGROUND OF THE INVENTION

1. Field of the Invention

The present invention generally relates to systems and methods for managing and controlling a well from the surface, and more particularly relates to a system and method that includes the transmission of downhole well data to the surface, the processing of the well data, and the transmission of commands to downhole controls to manage the well pursuant to the information derived from the downhole well data or other relevant sources. Still more particularly the present invention relates to recompleting an existing well using substantially continuous coilable tubing for the installation of a system and method for managing and controlling the recompleted well.

2. Description of the Related Art

In producing wells, it is desirable to determine if adjustments can be made to maintain or increase production, and if so, to determine if it is desirable to make those adjustments. This is referred to as managing a well and such a well management system with permanently installed sensors to monitor well conditions, and controls which can be adjusted from the surface, may be referred to as a intelligent completion system. In the management of wells, particularly producing wells, it is important to obtain downhole well data to manage and control the production of hydrocarbons over the life of the well. Problems arise in communicating and maintaining downhole sensors and controls which will last throughout the life of the well. Therefore, it is often necessary to monitor the producing well at the surface and to use flow controls located at the surface, such as a choke or other adjustable restriction, to control the flow from the producing formations.

It is expensive to intervene in a well by conventional methods. If adjustments can be made to optimize the well without expensive intervention, then there is an advantage to completing or recompleting the well using a intelligent completion system. This is particularly true of offshore wells where conventional intervention can involve costly equipment and lengthy interruption to supply. Optimization can also extend the economic life of a well.

Petroleum Engineering Services has developed a intelligent completion system referred to as the surface controlled reservoir analysis and management system ("SCRAMS") for providing surface control of downhole production tools in a well. SCRAMS is described in U.S. Pat. No. 5,547,029, hereby incorporated herein by reference. SCRAMS is capable of detecting well conditions and of generating command signals for operating one or more well tools. An electric conductor transmits electric signals and a hydraulic line containing pressurized hydraulic fluid provides the power necessary to operate downhole tools. The well control tool also permits the selective operation of multiple production zones in a producing well.

Intelligent completion systems are sometimes installed in existing wells where production is waning and steps need to be taken to enhance well production, such as for example by reperforating the production zone or perforating a new production zone. Thus it becomes necessary to workover or recomplete the existing producing well and install an intelligent completion management system to monitor and control the well downhole and more particularly to control production between the old and new perforations or production zones. This may become necessary as one or another of the producing zones begins to produce a substantial amount of water as compared to the amount of hydrocarbons being produced. Typically, data acquisition and the sending of commands downhole are performed independently at the surface.

In conventional recompletions, to install an intelligent completion system, the original completion must be removed and the downhole assembly of the intelligent completion system lowered into the borehole of the well on jointed pipe with an umbilical strapped to the outside of the jointed pipe as it is lowered into the borehole from a standard rig. The umbilical includes a bundle of conductors with a wire rope or cable typically covered in a protective sleeve. Often the conductors are housed in conduits with the wire rope protecting the conduits. The bundle may then be strapped to the jointed pipe the assembly is lowered into the well. The conductors are connected to the surface equipment uphole and to the sensors and control devices downhole to transmit data and electrical power. The hydraulic line may be run adjacent to the jointed pipe. The use of jointed pipe and conventional rig equipment for the recompletion is expensive. Also strapping the wireline onto the outside of the jointed pipe is problematic because it introduces the risk of damage to the conductors and subsequent well control problems.

Another disadvantage of conventional systems is that the use of jointed pipe requires the removal of the production tubing from the existing well. The production tubing is not large enough to allow the jointed pipe and umbilical to pass through it and therefore must be removed.

Today, installing the intelligent completion system by conventional means is sufficiently expensive to limit its use in some cases. Further, if the intelligent completion system does not work, the conventional intelligent completion system cannot be easily removed and then reinstalled. To correct a problem, the intelligent completion system must be pulled and a new intelligent completion system installed requiring that the investment be made all over again.

It is known to use steel continuous tubing for completions. Also, steel continuous tubing has been used to install down hole electrical submersible pumps which have a cable extending through the continuous tubing for powering the pump. See for example the paper entitled "Electric Submersible Pump for Subsea Completed Wells" by Sigbjom Sangesland given at Helsinki University of Technology on Nov. 26–27, 1991, hereby incorporated herein by reference. Electrical conductors are shown extending down through steel continuous tubing to provide power to a downhole submersible pump supported on the end of the continuous tubing.

One disadvantage of steel continuous tubing is that the weight of the steel continuous tubing in large diameters and long lengths makes its use impractical. This is particularly true where the steel continuous tubing is several inches in diameter.

One possible solution is the use of a non-metallic continuous tubing such as a continuous tubing made of composite materials. Composite continuous tubing generally is much lighter and more flexible than steel continuous tubing. Composite continuous tubing is still in the developmental stage for possible application in drilling, completion, production, intervention and workover. Composite continuous tubing may also be possibly used for service work, downhole installations, and artificial lift installations. It is also known to extend conductors through the composite tubing. These conductors may be electrical conductors, hydraulic conductors, or optical fibers. See for example U.S. Pat. Nos. 4,256,146; 4,336,415; 4,463,814; 5,172,765; 5,285,008; 5,285,204; 5,769,160; 5,828,003; 5,908,049; 5,913,337; and 5,921,285, all hereby incorporated herein by reference.

The present invention overcomes the deficiencies of the prior art.

SUMMARY OF THE INVENTION

Accordingly, there is disclosed herein a system and method for managing a new well or recompleting an existing well. In one embodiment, the well management system includes a sensor and a control disposed within a well, a surface control system which includes a data acquisition system, a data processing system and a controls activation system at the surface, a continuous tubing string extending into the well, and a conductor disposed on the continuous tubing string. The conductor connects the sensors and controls to the surface system to allow monitoring of the sensors and to operate the controls in response to the downhole conditions. The data processing system may be programmed to analyze the data and automatically activate the controls activation system to change settings of the controls downhole. Another conductor may also be provided along the continuous tubing string to conduct power from a surface power supply to the sensors and controls. The conductors may be electrical conductors, optical fibers, and/or hydraulic conduits. The controls are preferably equipped with a sensor or other means of detecting and verifying the position, status or operation of the control and communicate verification to the surface control system via the conductor. Contemplated controls include valves, sliding sleeves, chokes, filters, packers, plugs, and pumps.

The present invention further contemplates a method for controlling production in a well. The method includes: (i) accessing well information by the data acquisition system from a sensor disposed downhole via a conductor disposed on a continuous tubing string extending into the well; (ii) processing the well information by the data processing system at the surface to determine a preferred setting for a control disposed downhole in the well; and (iii) transmitting signals by the controls activation system to one or more of the controls via an energy conductor on the continuous tubing string. The controls may operate in response to the control signals and transmit a verification signal indicative of the success of the operation.

The well management system and method may employ composite tubing which has numerous advantages, including the ability to be deployed through existing production tubing, to allow the recompletion of an existing well without removal of the existing production tubing. In some circumstances it may be possible to achieve recompletion while the well is live and producing. The composite continuous tubing string may be equipped with sensors along the string and with controls disposed downhole which can be activated from the surface to vary and control downhole conditions. Alternatively the downhole sensors and/or controls may be within packages or subs which are connected to the continuous tubing string when it is deployed into the well. Briefly, the sensors sense various conditions downhole and transmit that data to the surface through conductors in the wall of the composite continuous tubing. One or more controls downhole can then be actuated from the surface to change the well conditions. Alternatively, the data processing system at the surface may monitor and analyze the data being transmitted from downhole to determine whether various controls downhole need to be actuated to change the downhole producing conditions. If such is the case, then the appropriate control signals are sent from the surface by the controls activation system down through the conductors on the continuous tubing.

Further advantages will become apparent from the following description.

BRIEF DESCRIPTION OF THE DRAWINGS

A better understanding of the present invention can be obtained when the following detailed description of the preferred embodiment is considered in conjunction with the following drawings, in which.

Figure 1:
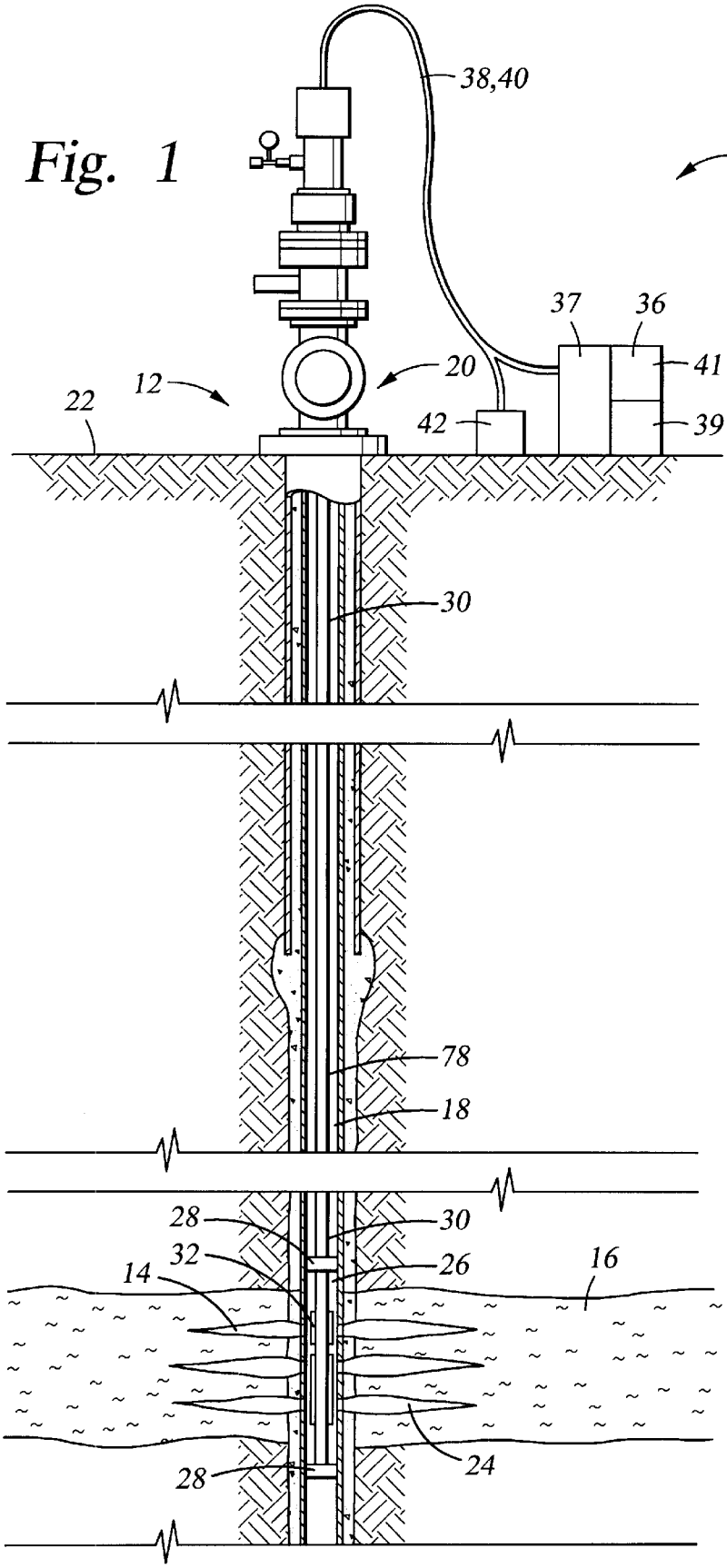
FIG. 1 is a schematic elevation view, partially in cross-section, of a new well with the intelligent completion system of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF THE PREFERRED EMBODIMENT

Figure 1A:
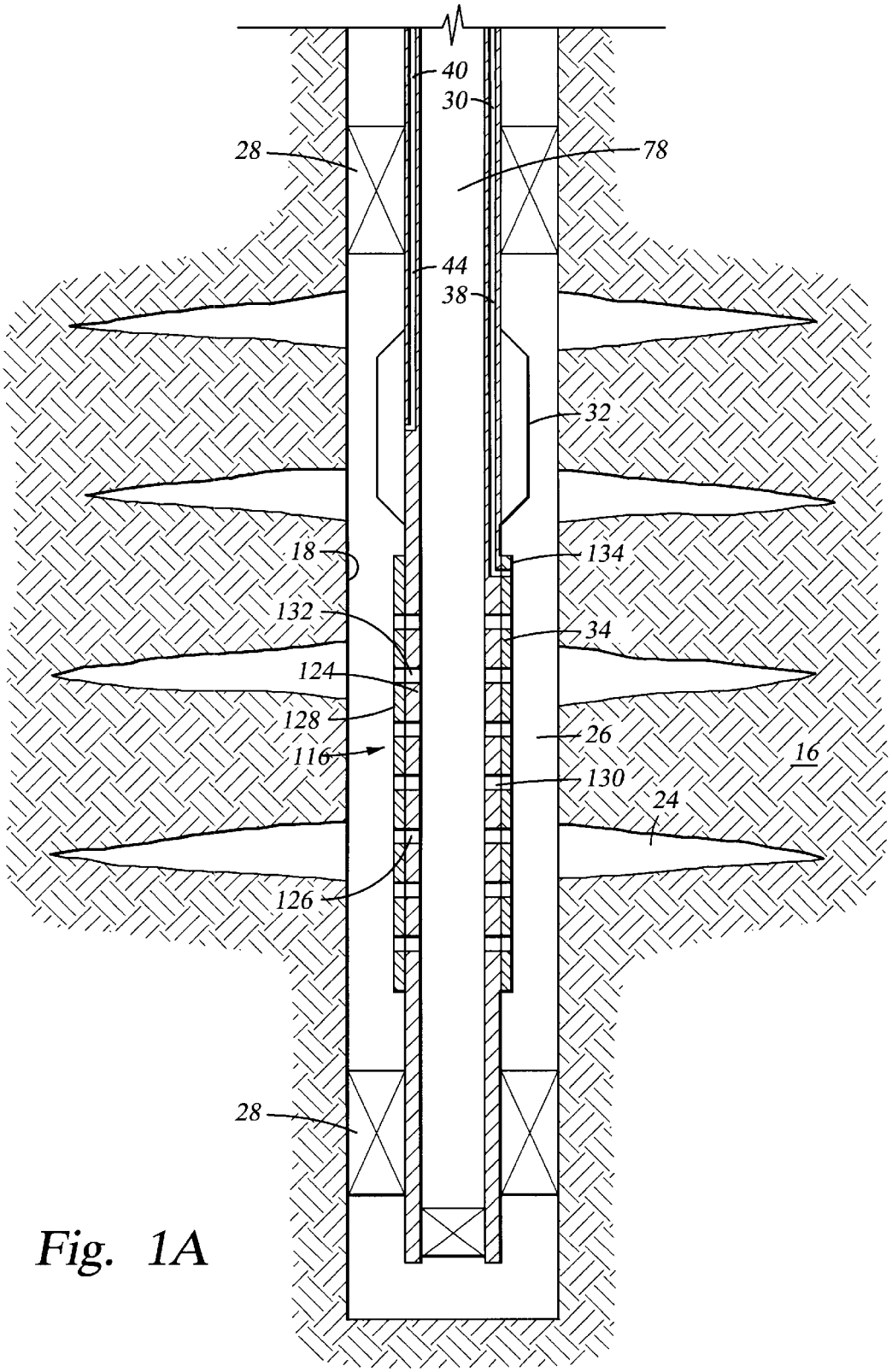
FIG. 1A is an enlarged view of the sensor and control disposed on the continuous tubing string of the intelligent completion system shown in FIG. 1.

Referring initially to FIGS. 1 and 1A, there is illustrated a intelligent completion system 10 of the present invention for monitoring, controlling and otherwise managing a well 12 producing hydrocarbons 14 from a formation 16. The well 12 typically includes casing 18 extending from the formation 16 to a wellhead 20 at the surface 22. The intelligent completion system 10 includes a substantially continuous tubing string 30 extending from the wellhead 20 down through the casing 18 and past formation 16. A continuous tubing string is defined as pipe which is substantially continuous in that it is not jointed pipe but has substantial lengths, such as hundreds or thousands of feet long, coupled together by a limited number of connections. Typically a continuous tubing string is coilable. Although the continuous tubing may be made of metal, it is preferably made of a non-metal, such as a composite, as hereinafter described. Casing 18 has been perforated at 24 to allow hydrocarbons 14 from formation 16 to flow into the flowbore 26 of casing 18. Packers 28 are typically used to isolate the producing formation 16 for directing the flow of the hydrocarbons to the surface.

The intelligent completion system 10 further includes one or more downhole sensors 32 disposed in the well 12 preferably adjacent the producing formation 16, one or more downhole controls 34 also disposed in the well 12 preferably adjacent the producing formation 16, and a surface control system 36 at the surface 22. Surface control system 36 includes a data acquisition system 37, a data processing system 39 and a controls activation system 41. A plurality of conductors 38, 40 connect the downhole sensors 32 with the data processing system 39 and the controls 34 with the controls activation system 41 of the surface control system 36. A power supply 42 is preferably also connected to one or more of the conductors 38, 40 to provide power downhole to the sensors 32 and controls 34 as needed. Although not required, the conductors 38, 40 are preferably housed in the wall 44 of tubing string 20 as hereinafter described.

In operation, the intelligent completion system 10 can be configured to acquire, store, display, and process data and other information received by the surface control system 36 from the downhole sensors 32 thereby allowing decisions to be made by the operator who can then make adjustments to the controls 34 by transmitting commands downhole to the controls 34 using the controls activation system 41. Alternatively the intelligent completion system 10 can be configured to require no manual intervention and automatically adjust the downhole controls 34 using the controls activation system 41 in response to the downhole information acquired from the downhole sensors 32 by the data acquisition system 37 and then processed by the data processing system 39. This allows the well 12 to be controlled and managed from the surface 22. Thus, the intelligent completion system 10 has the ability to change production conditions downhole in either a manual or automated, programmable fashion.

Figure 2:
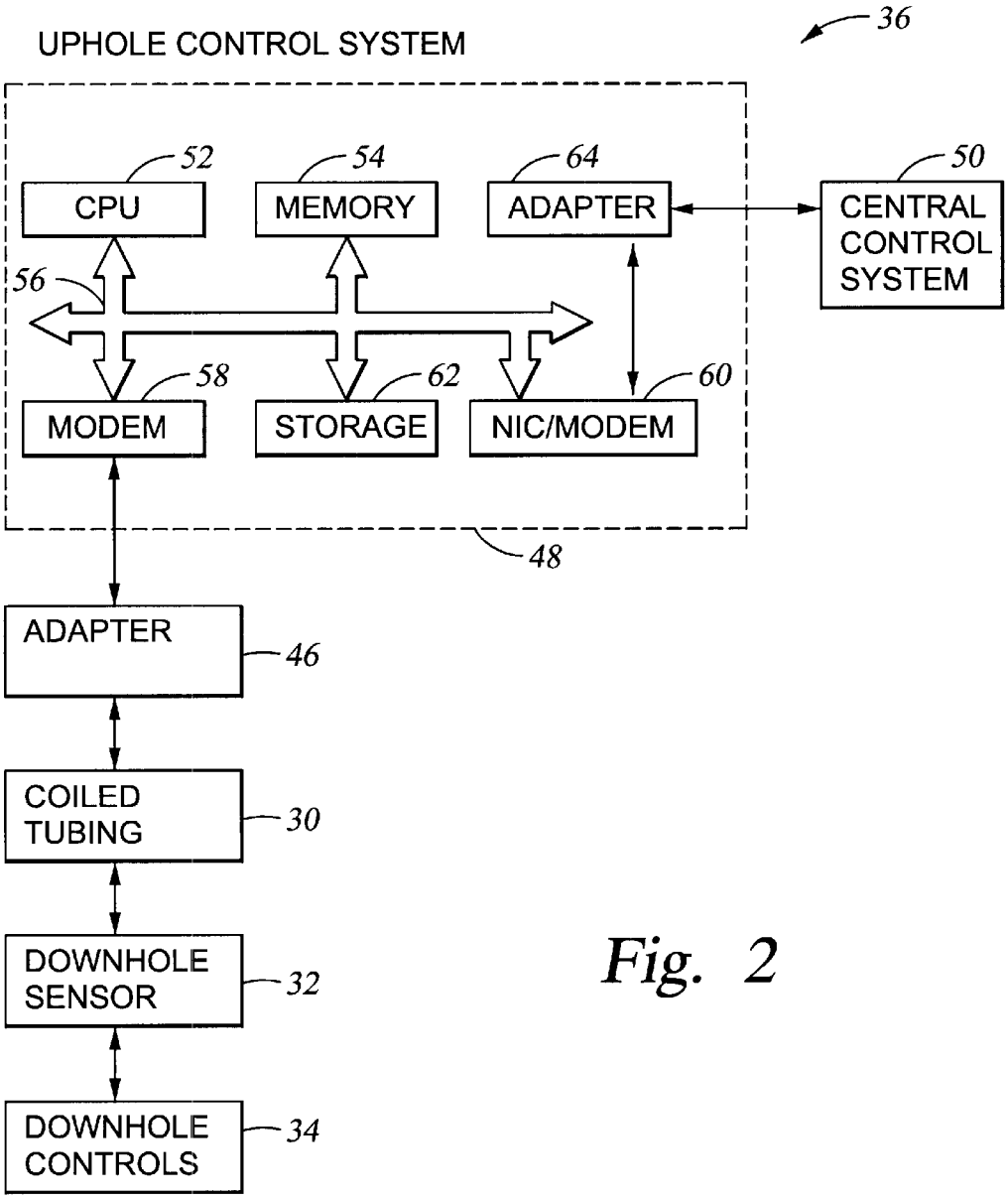
FIG. 2 is a block diagram of the intelligent completion system of FIG. 1 illustrating the connection of the components of the system.

Referring now to FIG. 2, there is shown a block diagram of the surface control system 36 for the automated and programmed operation of intelligent completion system 10. Surface control system 36 includes a control system 48 which is connected to downhole sensors 32 and controls 34 via "intelligent" continuous tubing string 30 and a central control system 50. These provide the data acquisition system 37, the data processing system 39 and the controls activation system 41. The control system 48 interfaces to the continuous tubing string 30 via an adapter 46. Downhole sensors 32 and controls 34 are preferably mounted on continuous tubing string 30. Adapter 46 preferably provides impedance matching and driver circuitry for transmitting signals downhole, and preferably provides detection and amplification circuitry for receiving signals from downhole sensors 32 and controls 34.

The control system 48 at the surface 22 preferably interfaces to central control system 50 which can perform remote monitoring and programming of control system 48. Control system 48 may provide status information regarding downhole conditions and system configuration to central control system 50, and the central control system 50 may provide new system configuration parameters based on information available from other sources such as e.g. seismic survey data and other information on the producing well.

Control system 48 may be programmed to determine a preferred set of downhole operating conditions in response to data received from the downhole sensors 32, the controls 34 and the central control system 50. After determining the preferred set of downhole operating conditions (which may change dynamically in response to downhole measurements), the control system 48 provides control signals to downhole controls 34. Using a feedback control scheme, the control system 48 then regulates the settings of the downhole controls 34 to bring the actual downhole operating conditions as close to the preferred set of operating conditions as possible.

In one embodiment, the control system 48 includes a processor (CPU) 52 and a memory module 54 coupled together by a bus 56. The system 48 further includes a modem 58 for communicating with downhole sensors 32 and controls 34 and a network interface (NIC) or modem 60 for communicating with the central control system 50. A long term information storage device 62 such as a flash-ROM or fixed disk drive is preferably also included.

Modem 58 connects via adapter 46 to continuous tubing string 30 to send messages to and receive messages from downhole sensors 32 and controls 34. An adapter 64 may also be provided for NIC 60 to send to and receive from central control system 50. Adapter 64 may be any suitable interface device such as an antenna, a fiber-optic adapter, or a phone line adapter.

During operation, memory module 54 includes executable software instructions that are carried out by CPU 52. These software instructions cause the CPU 52 to retrieve data from the downhole sensors 32, controls 34 and central control system 50. They also allow the CPU 52 to provide control signals to the downhole sensors 32 and controls 34 and status signals to the central control system 50. The software additionally allows the CPU 52 to perform other tasks such as feedback optimization of desired settings for downhole devices and iterative solving of nonlinear models to determine preferred downhole operating conditions.

The data acquisition system 37 of surface control system 36 monitors downhole conditions continuously in the practical sense, but not necessarily in the analog sense. Multiplexing and statistical averaging may be employed so that additional sensors and controls can be used. The actual readings from a particular device may only occur every few seconds, for example. Other sampling intervals may be preferred. For example, data samples may be taken at different times during the day and statistical averaging may be used to develop a downhole profile. The sampling frequency may depend upon the sensors themselves. For example, some sensors may require many samples to ultimately obtain the desired information, while more sensitive sensors may provide the necessary information from a much shorter sampling time period.

Although an automated and programmed surface control system 36 has been described, it should be appreciated that there may be manual intervention by the operator at any stage of the operation of the surface control system 36 and further that the surface control system 36 may be designed solely for manual operation, if desired, by displaying the data and processed information and providing a command center having a control panel for manual activation of the transmission of commands downhole to the controls 34.

It is not intended that sensors 32 be limited to any particular construction or be limited to the measurement of any particular downhole parameter or characteristic. Various sensors may be used as sensor 32 as for example and not by way of limitation a flow meter, densitometer, pressure gauge, spectral analyzer, seismic device, and hydrophone. For example and not by way of limitation, sensor 32 may detect or measure: flow, pressure, temperature, and gas/oil ratios. See for example U.S. Pat. Nos. 5,647,435; 5,730,219; 5,808,192; and 5,829,520, all hereby incorporated herein by reference. Sensor 32 may be located either in the flowbore 78 of continuous tubing string 30 or in the annulus 26 between casing 18 and continuous tubing string 30 at the producing formation 16. Sensor 32 may be provided to measure the flow inside the continuous tubing string 30. Sensor 32 may measure the amount of oil and gas being produced. However, in the final analysis, the sensor configuration is determined by the particular well 12. It of course should be appreciated that there may be a plurality of sensors measuring various well parameters and characteristics. Pressure and temperature are preferably measured both inside and outside the continuous tubing 30. The system 10 may initially include more sensors than can be concurrently operated. The individual sensors may be activated and de-activated as needed to gather downhole information. The sensor 32 illustrated in FIGS. 1 and 1A is preferably a flow control device which measures flow from the formation 16. See for example U.S. Pat. No. 4,636,934, hereby incorporated herein by reference.

Sensor 32 may be a permanent sensor that can perform three-phase monitoring of reservoirs. This will allow the sensors to determine the exact phases of liquid and gas being produced from the formation and to identify the quantity of water, gas and oil being produced.

The sensor 32 itself may be disposed in the well 12 in various ways. Referring again to FIG. 1A, sensor 32 may be in the form of a sensor module or sub disposed on the continuous tubing string 30 or formed as a part of the continuous tubing string 30, and is preferably located adjacent the producing formation 16. The sensor sub 32 may be disposed in the continuous tubing string 30 by connectors at each end of the sub 32. Alternatively, the continuous tubing string 30 may extend through the sensor sub 32 such that the sensor sub 32 is disposed around the outside of the continuous tubing string 30 as shown in FIG. 1A. In the former case, the sensor sub 32 may be installed by severing the continuous tubing string 30, connecting the sensor sub 32, and then attaching the continuous tubing string 30 to the other end of the sensor sub 32.

The sensor sub 32 contains pre-wired sensor packages for measuring the desired downhole parameters. These pre-wired sensor packages are then connected to the conduits 38, 40. The sensor sub 32 senses a particular array of downhole characteristics or parameters required at the surface 22 by control system 36 to properly control the well downhole. As a still further alternative, sensor 32 may be housed in the wall of continuous tubing string 30 rather than in a sensor sub.

Figure 3:
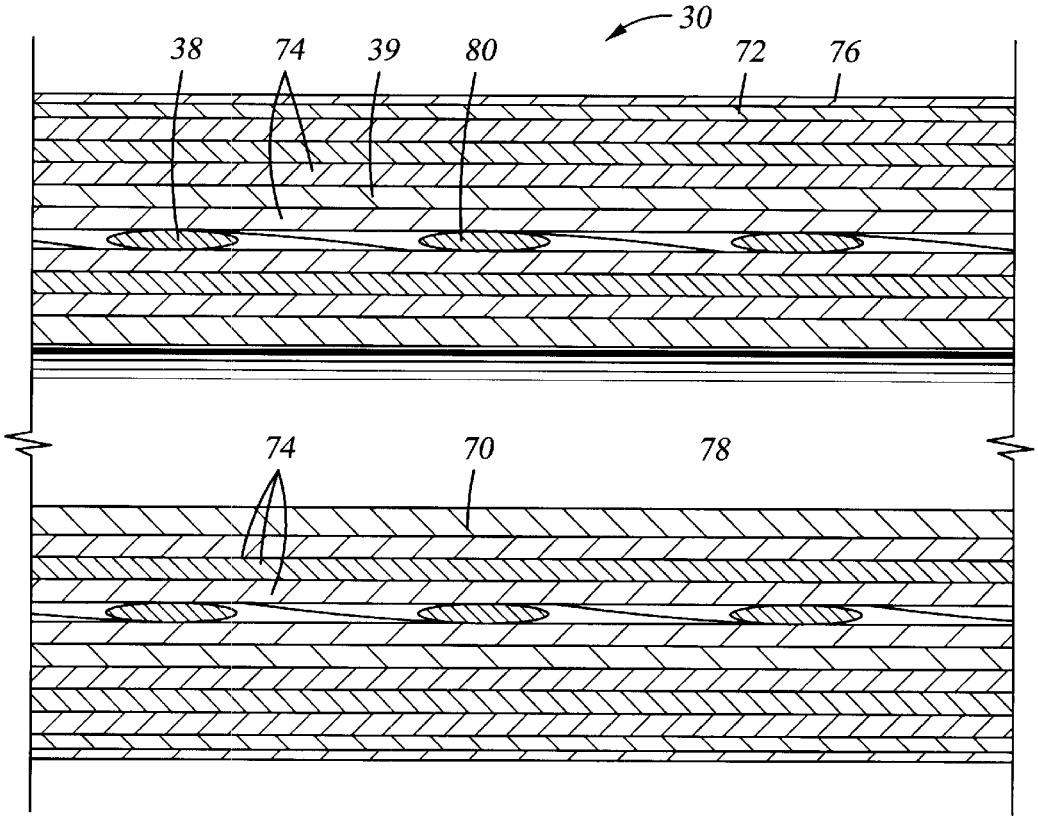
FIG. 3 is a cross-section along the longitudinal axis of a composite continuous tubing used for the continuous tubing string of the intelligent completion system shown in FIG. 1.
Figure 4:
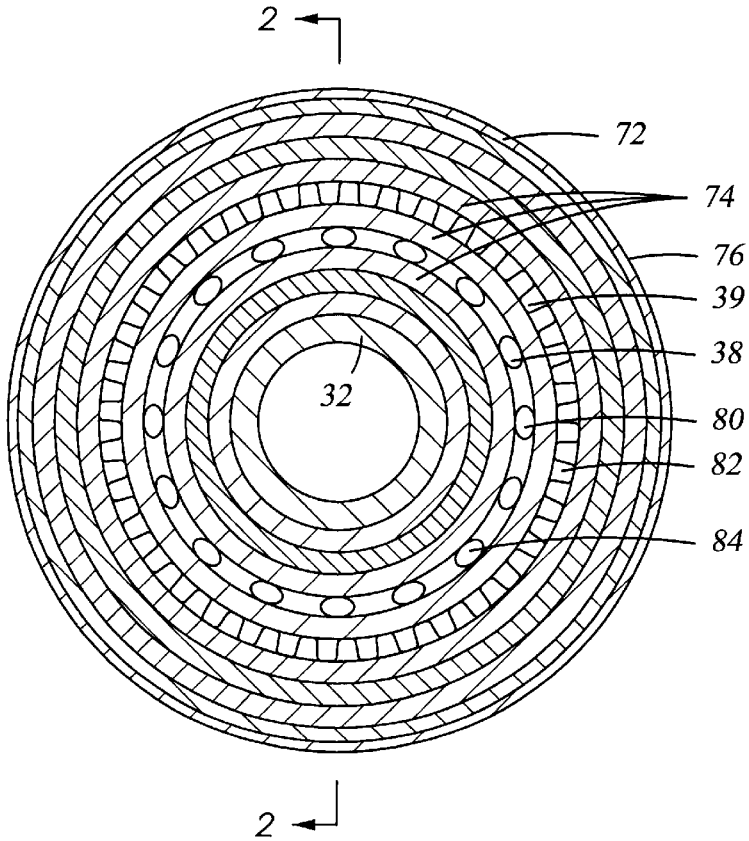
FIG. 4 is a cross-section perpendicular to the axis of the composite continuous tubing shown in FIG. 3.

Referring now to FIGS. 3 and 4, continuous tubing string 30 is preferably continuous tubing made of a composite material. See related U.S. patent application Ser. No. 09/081,961 filed May 20, 1998 entitled Drilling System, hereby incorporated herein by reference. Composite continuous tubing 30 preferably has an impermeable fluid liner 70, a plurality of load carrying layers 74, and a wear layer 76. As best shown in FIG. 4, conductors 38, 40 and sensor 32 are embedded in the load carrying layers 74. These conductors may be metallic or fiber optic conductors, such as energy conductors 38 and data transmission conductors 40. The energy conductors 38 are shown as electrical conductors, but may be hydraulic conduits which conduct hydraulic power downhole. See for example U.S. Pat. No. 5,744,877, hereby incorporated herein by reference. In an alternative embodiment, optical fibers are used for powering and receiving information from downhole sensors, and hydraulic conduits are used to drive the downhole controls. This embodiment may be preferred where it is deemed undesirable to run electricity downhole. The sensors in this embodiment can be electrical (powered by photovoltaic cells), but it may be more pragmatic to use optical sensors. Optical sensors are expected to be more robust and more reliable over time. The energy conductors may be used to provide both power and control signals for the downhole sensor 32 and control 34, and may be used to transmit information from the downhole sensor 32 and control 34 to the surface 22.

Types of composite tubing are shown and described in U.S. Pat. Nos. 5,018,583; 5,097,870; 5,172,765; 5,176,180; 5,285,008; 5,285,204; 5,330,807; 5,348,096; 5,469,916; 5,828,003, 5,908,049; and 5,913,337, all of these patents being hereby incorporated herein by reference. See also "Development of Composite Coiled Tubing for Oilfield Services," by A. Sas-Jaworsky and J. G. Williams, SPE Paper 26536, 1993, hereby incorporated herein by reference. Examples of composite tubing with rods, electrical conductors, optical fibers, or hydraulic conductors are shown and described in U.S. Pat. Nos. 4,256,146; 4,336,415; 4,463,814; 5,080,175; 5,172,765; 5,234,058; 5,437,899; 5,540,870; and 5,921,285, all of these patents being hereby incorporated herein by reference.

The substantially impermeable fluid liner 70 is an inner tube preferably made of a polymer, such as polyvinyl chloride or polyethylene. Liner 70 can also be made of a nylon, other special polymer, or elastomer. In selecting an appropriate material for fluid liner 70, consideration is given to the chemicals in the fluids to be produced from well 12 and the temperatures to be encountered downhole. The primary purpose for inner liner 70 is as an impermeable fluid barrier since carbon fibers are not impervious to fluid migration particularly after they have been bent. The inner liner 70 is substantially impermeable to fluids and thereby isolates the load carrying layers 74 from the well fluids passing through the flow bore 78 of liner 70. Inner liner 70 also serves as a mandrel for the application of the load carrying layers 74 during the manufacturing process for the composite continuous tubing 30.

The load carrying layers 74 are preferably a resin fiber having a sufficient number of layers to sustain the load of the continuous tubing string 30 suspended in fluid, including the weight of the composite continuous tubing 30, the sensors 32 and controllers 34. For example, the composite continuous tubing 30 of FIG. 3 has six load carrying layers 74.

The fibers of load carrying layers 74 are preferably wound and/or braided into a thermal-setting or curable resin. Carbon fibers are preferred because of their strength, and although glass fibers may also be preferred since glass fibers are much less expensive than carbon fibers. Also, a hybrid of carbon and glass fibers may be used. Thus, the particular fibers for the load carrying layers 74 will depend upon the well, particularly the depth of the well, such that an appropriate compromise of strength, longevity and cost may be achieved in the fiber selected.

Load carrying fibers 74 provide the mechanical properties of the composite continuous tubing 30. The load carrying layers 74 are wrapped and/or braided so as to provide the composite continuous tubing 30 with various mechanical properties including tensile and compressive strength, burst strength, flexibility, resistance to caustic fluids, gas invasion, external hydrostatic pressure, internal fluid pressure, ability to be stripped into the borehole, density i.e. flotation, fatigue resistance and other mechanical properties. Fibers 74 are uniquely wrapped and/or braided to maximize the mechanical properties of composite continuous tubing 30 including adding substantially to its strength.

The wear layer 76 is wrapped and/or braided around the outermost load carrying layer 74. The wear layer 76 is a sacrificial layer since it will engage the inner wall of casing 18 and will wear as the composite continuous tubing 30 is tripped into the well 12. Wear layer 76 protects the underlying load carrying layers 74. One preferred wear layer is that of Kevlar™ which is a very strong material which is resistant to abrasion. Although only one wear layer 76 is shown, there may be additional wear layers as required. It should be appreciated that inner liner 70 and wear layer 76 are not critical to the use of composite continuous tubing 30 and may not be required in certain applications. A pressure layer 72 may also be applied although not required.

During the fabrication process, electrical conductors 38, data transmission conductors 40, one or more sensors 32 and other data links may be embedded between the load carrying layers 74 in the wall of composite continuous tubing 30.

These are wound into the wall of composite continuous tubing 30 with the carbon, hybrid, or glass fibers of load carrying layers 74. It should be appreciated that any number of electrical conductors 38, data transmission conduits 40, and sensors 32 may be embedded as desired in the wall of composite continuous tubing 30.

The electrical conductors 38 may include one or more copper wires such as wire 80, multi-conductor copper wires, braided wires such as at 82, or coaxial woven conductors. These are connected to a power supply at the surface. A braided copper wire 82 or coaxial cable 84 may be wound with the fibers integral to the load carrying layers 74. Although solid copper wires may be used, a braided copper wire 82 may provide a greater transmission capacity with reduced resistance along composite continuous tubing 30. Braided copper wire 82 allows the transmission of a large amount of electrical power from the surface 22 to the sensor 32 and control 34 through essentially a single conductor. With multiplexing, there may be two-way communication through a single conductor 80 between the surface 22 and sensor 32 and control 34. This single conductor 80 may provide data transmission to the surface 22.

The data transmission conduit 40 may be a plurality of fiber optic data strands or cables providing communication to the control system 36 at the surface 22 such that all data is transmitted in either direction optically. Fiber optic cables provide a broad transmission bandwidth and can support two-way communication between sensor 32 and controls 34 and the surface control system 36. The fiber optic cable may be linear or spirally wound in the carbon, hybrid or glass fibers of load carrying layers 74.

One or more of the data transmission conduits 40 may include a plurality of sensors 32. It should be appreciated that the conduits may be passages extending the length of composite continuous tubing 30 for the transmission of fluids. Sensors 32 may be embedded in the load carrying layers 74 and connected to one or more of the data transmission conductors 40 such as a fiber optic cable. As an alternative to embedded discrete sensors, the fiber optic cable may be etched at various intervals along its length to serve as a sensor at predetermined locations along the length of composite continuous tubing 30. This allows the pressures, temperatures and other parameters to be monitored along the composite continuous tubing 30 and transmitted to the control system 36 at the surface 22.

Composite continuous tubing 30 is coilable so that it may be spooled onto a drum. In the manufacturing of composite continuous tubing 30, inner liner 70 is spooled off a drum and passed linearly through winding and /or braiding machines. The carbon, hybrid, or glass fibers are then wound and/or braided onto the inner liner 70 as liner 70 passes through multiple machines, each setting a layer of fiber onto inner liner 70. The finished composite continuous tubing 30 is then spooled onto a drum.

During the winding and/or braiding process, the electrical conductors 38, data transmission conductors 40, and one or more sensors 32 are applied to the composite continuous tubing 30 between the braiding of load carrying layers 74. Conductors 38, 40 may be laid linearly, wound spirally or braided around continuous tubing 30 during the manufacturing process while braiding the fibers. Further, conductors 38, 40 may be wound at a particular angle so as to compensate for the expansion of inner liner 70 upon pressurization of composite continuous tubing 30.

Composite continuous tubing 30 may be made of various diameters. The size of continuous tubing 30, of course, will be determined by the particular application and well for which it is to be used.

Although it is possible that the composite continuous tubing 30 may have any continuous length, such as up to 25,000 feet, it is preferred that the composite continuous tubing 30 be manufactured in shorter lengths as, for example, in 1,000, 5,000, and 10,000 foot lengths. A typical drum will hold approximately 12,000 feet of composite tubing. However, it is typical to have additional back up drums available with additional composite continuous tubing 30. These drums, of course, may be used to add or shorten the length of the composite continuous tubing 30. With respect to the diameters and weight of the composite continuous tubing 30, there is no practical limitation as to its length.

Composite continuous tubing 30 has all of the properties requisite to the production of hydrocarbons over the life of the well 12. In particular, composite continuous tubing 30 has great strength for its weight when suspended in fluid as compared to ferrous materials and has good longevity. Composite continuous tubing 30 also is compatible with the hydrocarbons and other fluids produced in the well 12 and approaches buoyancy (dependent upon mud weight and density) when immersed in well fluids.

There are various connectors which are used with composite tubing. A top end connector connects the composite continuous tubing 30 to the surface controls 36 and power supply 42. Other connectors will connect the end of the composite tubing to the downhole portion of the intelligent completion system or to a sensor 32 or control 34. A further connector is a tube-to-tube connector for connecting adjacent ends of the composite continuous tubing. Examples of connectors are shown in PCT Publication WO 97/12115 published Apr. 3, 1997, U.S. Pat. Nos. 4,936,618; 5,156,206; and 5,443,099, all hereby incorporated herein by reference.

Other embodiments of composite continuous tubing may be used without embedding the conductors in the wall of the tubing. For example and not by way of limitation, a liner may be disposed inside an outer tubing with the conductors housed between the liner and tubing wall. A further method includes dual wall pipe with one pipe housed within another pipe and the conductors disposed between the walls of the dual pipes. See U.S. Pat. Nos. 4,336,415 and 4,463,814. A still another method includes a plurality of inner pipes within an outer pipe. See U.S. Pat. No. 4,256,146. A still another embodiment may include attaching two tubing strings together and lowering them into the well. See U.S. Pat. No. 4,463,814. A sealing process would be required to seal the well as the pair of conduits is lowered into the well.

Although the preferred embodiment of the intelligent completion system 10 includes the use of composite continuous tubing, it should be appreciated that many of the features of the present invention may be used with a continuous tubing string other than composite continuous tubing. Any continuous tubing string which allows the energy conductors to be installed in the well with the continuous tubing string, may be used with the intelligent completion system 10.

Composite continuous tubing is preferred over metal continuous tubing. It should be appreciated that the continuous tubing may be a combination of metal and composite such as a metal tubing on the outside with a plastic liner disposed inside the metal tubing. See also U.S. Pat. No. 5,060,737.

Although metal continuous tubing is a single, continuous tube, generally wound around a spool for transportation and use at the well site, composite continuous tubing is generally preferred over metal continuous tubing. Composite continuous tubing has the advantage of not being as heavy as metal continuous tubing. Further, since the data transmission and power conduits and conductors cannot be housed in the wall of metal continuous tubing, they are disposed in an umbilical which must be disposed on either inside or outside of the metal tubing.

The electrical conductors may be run through the internal flowbore of the metal continuous tubing. However, electrical wires cannot support themselves in that their weight causes them to stretch and then break. Thus, it is necessary to support the wires within the flowbore of the metal tubing to transfer the weight of the wire to the tubing. See U.S. Pat. No. 5,920,032, hereby incorporated herein by reference. If the umbilical is placed inside the metal continuous tubing, the umbilical may also interfere with tools passing through the flowbore of the tubing.

It is not intended that control 34 be limited to any particular construction or be limited to any particular downhole action or activity for the control and/or management of the well 12. Various controls devices may be used as control 34. For example and not by limitation, control 34 may be a valve, sliding sleeve, flow control member, flow restrictor, plug, isolation device, pressure regulator, permeability control, packer, downhole safety valve, turbulence suppressor, bubbler, heater, downhole pump, artificial lift device, sensor control, or other robotic device for the downhole control and management of the well 12 from the surface 22. Examples of downhole controls are described in PCT Publication WO 99/05387 on Feb. 4, 1999 and in U.S. Pat. Nos. 5,706,892; 5,803,167; 5,868,201; 5,896,928; and 5,906,238, these patents and publication being hereby incorporated herein by reference.

It should be appreciated that control 34 may be in the form a choke. Conventionally a choke at the wellhead controls and manages the flow of well fluids produced from the well. In accordance with the present invention, control 34 in the form of a choke is located downhole to provide the management of flow downhole rather than at the surface to allow management of individual producing intervals, sand units, or producing zones.

Various types of flow control devices may be activated downhole to restrict flow like a choke, which may be defined as any restriction device that holds back flow and is physically placed in the flow path. One type of flow control device may a valve located in the flowbore to open and close the flowbore to the flow of production fluids to the surface. This is simply an open and closed position device. A second type of flow control device may be an isolation device, such as a ball valve, to close off or plug off a lower producing formation isolating the lower zone from the upper zone.

A third type of flow control device may be a sliding sleeve disposed in the continuous tubing string to permit or block the flow of hydrocarbons from the annulus 26 into the flowbore 78 of the continuous tubing string 30 or production tubing. This type of device opens and closes apertures through the wall 44 of the continuous tubing string 30 into the flowbore 78. A fourth type of flow control device is a multi-position device, similar to a sliding sleeve, where the ports into the flowbore have several flow positions. In that instance, various porting arrangements may be sized in the sliding sleeve prior to installation. Thus, rather than just open or closed, various sized ports for controlling flow can be selected. A fifth type of flow control device is an infinitely variable ported sleeve. See PCT Publication WO 99/05387 published on Feb. 4, 1999, hereby incorporated herein by reference. These may also be sliding sleeves, although there are various ways of varying the flow into the flowbore. A sixth type of flow control device controls the permeability of the wall through which the hydrocarbons flow into the flowbore 78, such as a filter that has a variable permeability.

Referring again to FIG. 1A, an exemplary flow control device 116 is shown as control 34. Flow control device 116 has a housing 124 with ports 126 and a reciprocable sleeve 128 also with ports 132 to provide variable flow apertures 130 between annulus 26 and flowbore 78 of continuous tubing string 30. The apertures 130 may be full open, partially open, or closed, depending on the position of the ports 126, 132 in the housing 124 and sleeve 128. Flow control device 116 also includes an electric motorized member 134 for reciprocating the ported sleeve 128. Power, command, and telemetry signals pass between the continuous tubing string 30 and electric motorized member 134. The flow control device 116 can, in response to a command signal, use the power received from the embedded energy conductors 38 to reciprocate the sleeve 128 to adjust or close the variable aperture area(s) 130. The flow control device 116 can then transmit a signal to the surface 22 to indicate successful completion of the aperture setting after the adjustment is completed. See for example U.S. Pat. No. 5,666,050, hereby incorporated herein by reference. The flow control device 116 may also include sensors for such things as temperature, pressure, fluid density, and flow rate. The data from these sensors is also transmitted to the surface 22.

Figure 5:
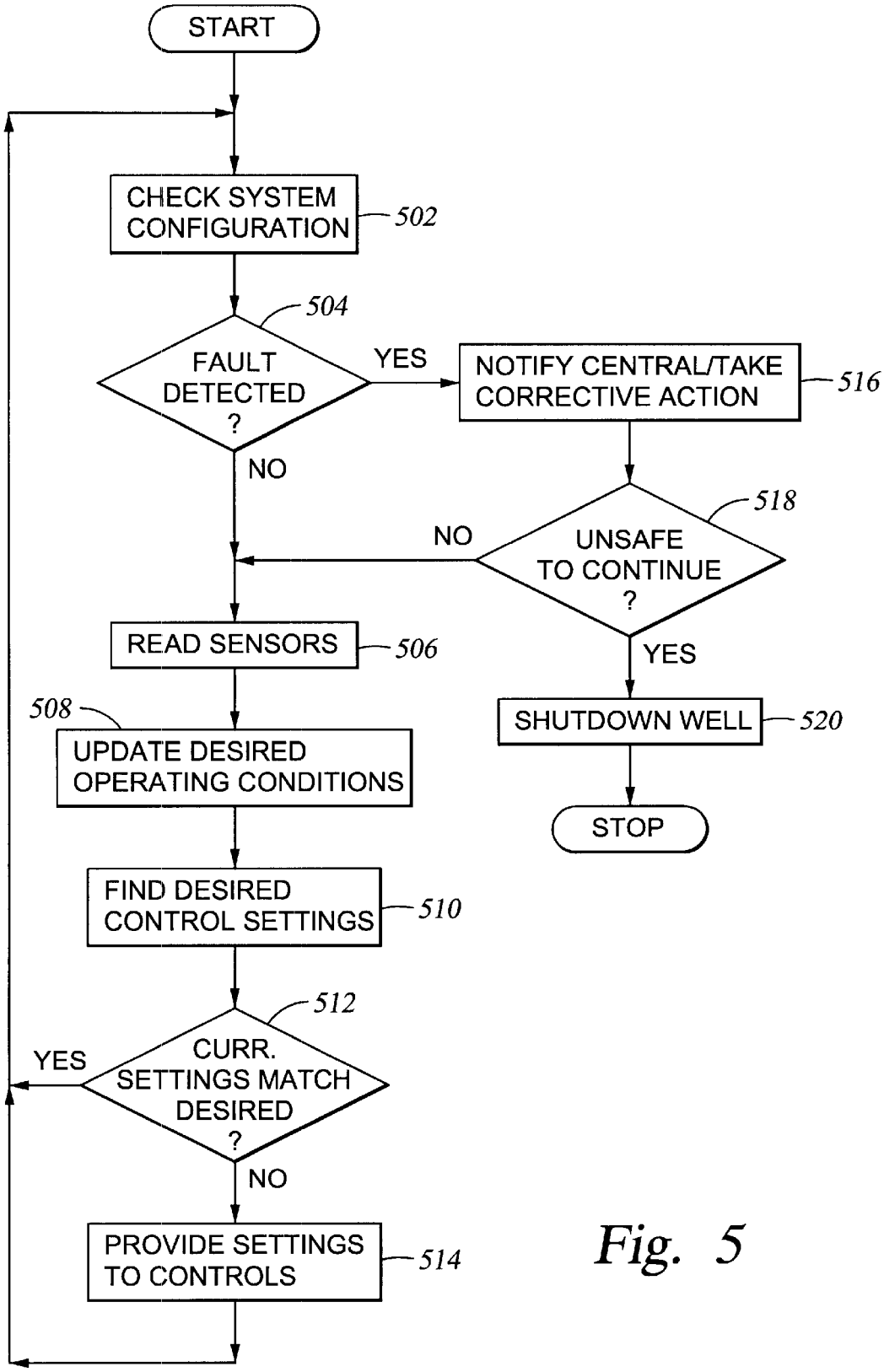
FIG. 5 is a flow chart of the intelligent completion system of FIG. 1.

Referring now to FIG. 5, there is shown a flow chart of the automatic operation of the intelligent completion system 10. Surface control system 48 begins with block 502 by checking the system configuration. This includes a survey of all downhole components to verify their status and functionality, and this further includes a verification of the communications link to central control system 50. This check may also include a check of the functionality of various components of the surface control system 36 itself. Other aspects of this check may include checking for the existence of configuration updates from the central control system 50, checking for currency of backup and log information, and verifying the validity of recent log data stored in long-term information storage 62.

If during the check in block 502, no fault is detected, then in block 504 the control system 48 branches to block 506 where data is gathered by the data acquisition system 37 from the downhole sensors 32. In block 508, the data processing system 39 of control system 48 processes the downhole data to determine the operating conditions downhole. In response to the derived conditions, the surface control system 36 may adaptively change the desired operating conditions. Once desired operating conditions have been determined, in block 510 the surface control system 36 determines the desired settings for the downhole control devices. This determination may be performed adaptively in response to the derived information from the sensors 32. In block 512, a check is performed to determine if the current device settings match the desired device settings. If they match, no action is taken, and the surface control system 48 returns to block 502. If they do not match, the controls activation system 41 of surface control system 48 transmits control signals to the downhole controls 34 to adjust the current settings.

If in block 502 a fault was detected, then in block 504 the control system 48 branches to block 516. In block 516 the control system 48 transmits an alarm message to central control system 50 and takes appropriate corrective action. A check is made in block 518 as to the safety of continued operation, and if it is safe, the control system 48 continues operation with block 506. Otherwise, the control system 48 shuts down the well in block 520 and ceases operation.

Figure 6:
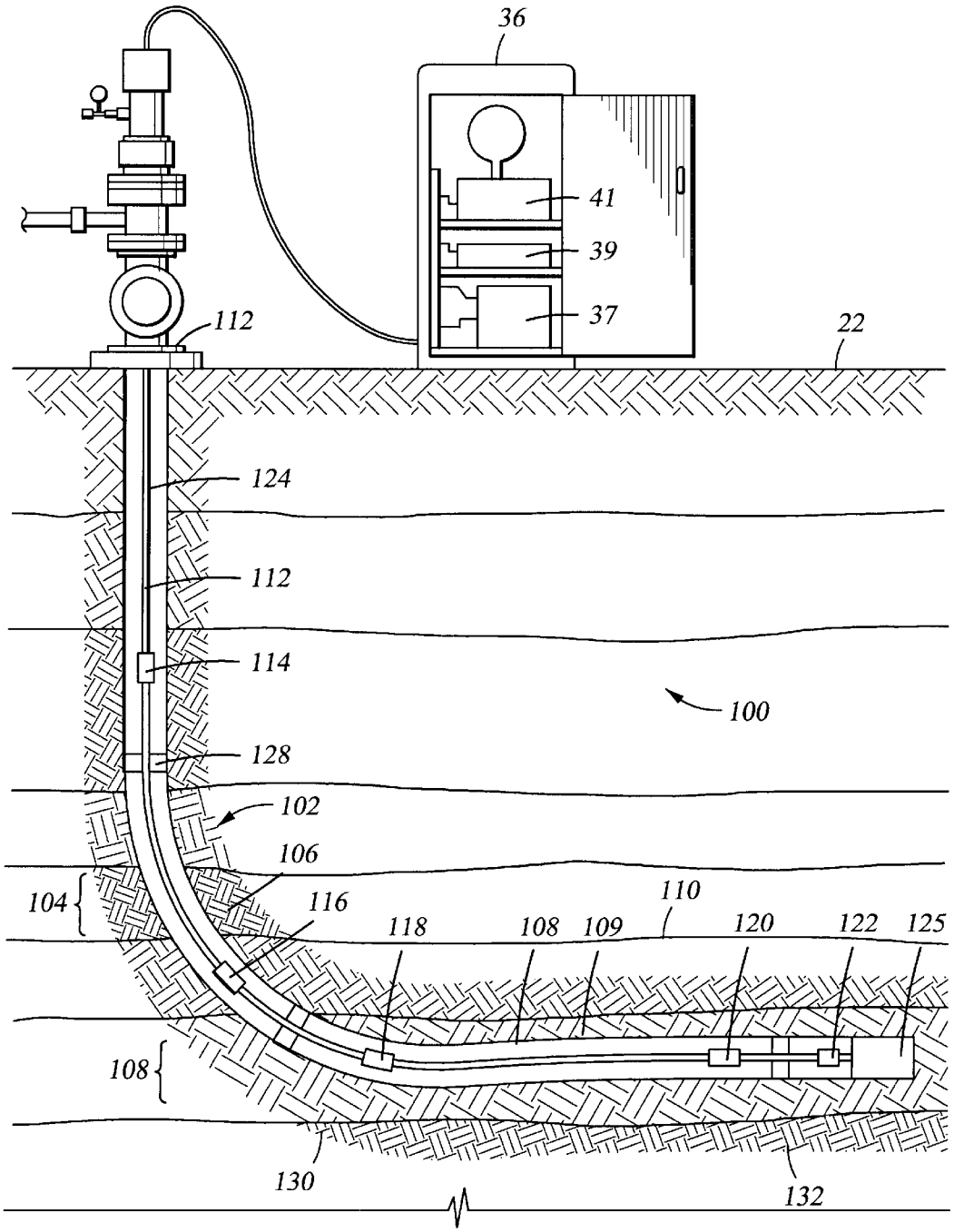
FIG. 6 is a schematic elevation view, partially in cross-section, of a new well having a deviated borehole with another embodiment of the intelligent completion system of the present invention.

Referring now to FIG. 6, there is shown the use of an intelligent completion system 100 in a well having multiple producing formations with one of the producing formations having multiple production zones. Well 102 has a upper producing formation 104 with a completion 106 and a lower producing formation 108 having multiple completions 109, 110. Suspended from well head 112 is a continuous tubing string 112 having various downhole modules 114, 116, 118, 120, and 122 at selected intervals. The continuous tubing string 112 is preferably composite continuous tubing which extends from the surface 22 and typically down to the bottom 126 of the well 102. A tractor 125 may be used to pull the intelligent completion into position. This is particularly applicable in horizontal wells. Tractor 125 is preferably a disposable tractor in that the tractor 125 would not be retrieved from downhole. The tractor 125 would preferably be disposed below the lowermost production zone. Examples of tractors which may be used are disclosed in PCT Publication WO 98/01651 published on Jan. 15, 1998 and in U.S. Pat. Nos. 5,186,264 and 5,794,703, all of which are hereby incorporated herein by reference. As there is typically a cement plug at the bottom of the well, it is not necessary for the composite continuous tubing 110 to go completely to the bottom of the well.

Continuous tubing string 110 preferably incorporates conductors 38, 40 that communicate power and control signals from surface control system 36 to the downhole modules. Surface control of these modules by the control activation system 41 is thereby achieved without passing additional conduits or cables downhole. This is expected to significantly enhance the feasibility of a surface control reservoir analysis and management system. The downhole modules may be further configured to provide status and measurement signals to the data acquisition system 37 via the conductors 38, 40. Packers 128, 130, and 132 separate the upper producing zone from the lower producing zone.

The downhole modules 114–122 preferably include various sensors 32 for measuring downhole conditions while some of the modules preferably also include controls 34. The sensors 32 measure various parameters at every producing interval. This allows these parameters to be measured at each producing reservoir. Modules 116, 118, and 120, for example, may include both sensors 32 and controls 34 to monitor and regulate flow into the flowbore 124 of continuous tubing 112. Controls 34 preferably include variable apertures for controlling flow from the producing formation into the continuous tubing 112. Uppermost module 114 may include a multi-position valve to regulate the flow through the flowbore 124 of continuous tubing 112 to enhance (or suppress) bubble formation in the hydrocarbons. Lowermost module 122 may also include a multi-position valve to close off flow below the lower producing zone.

Figure 7:
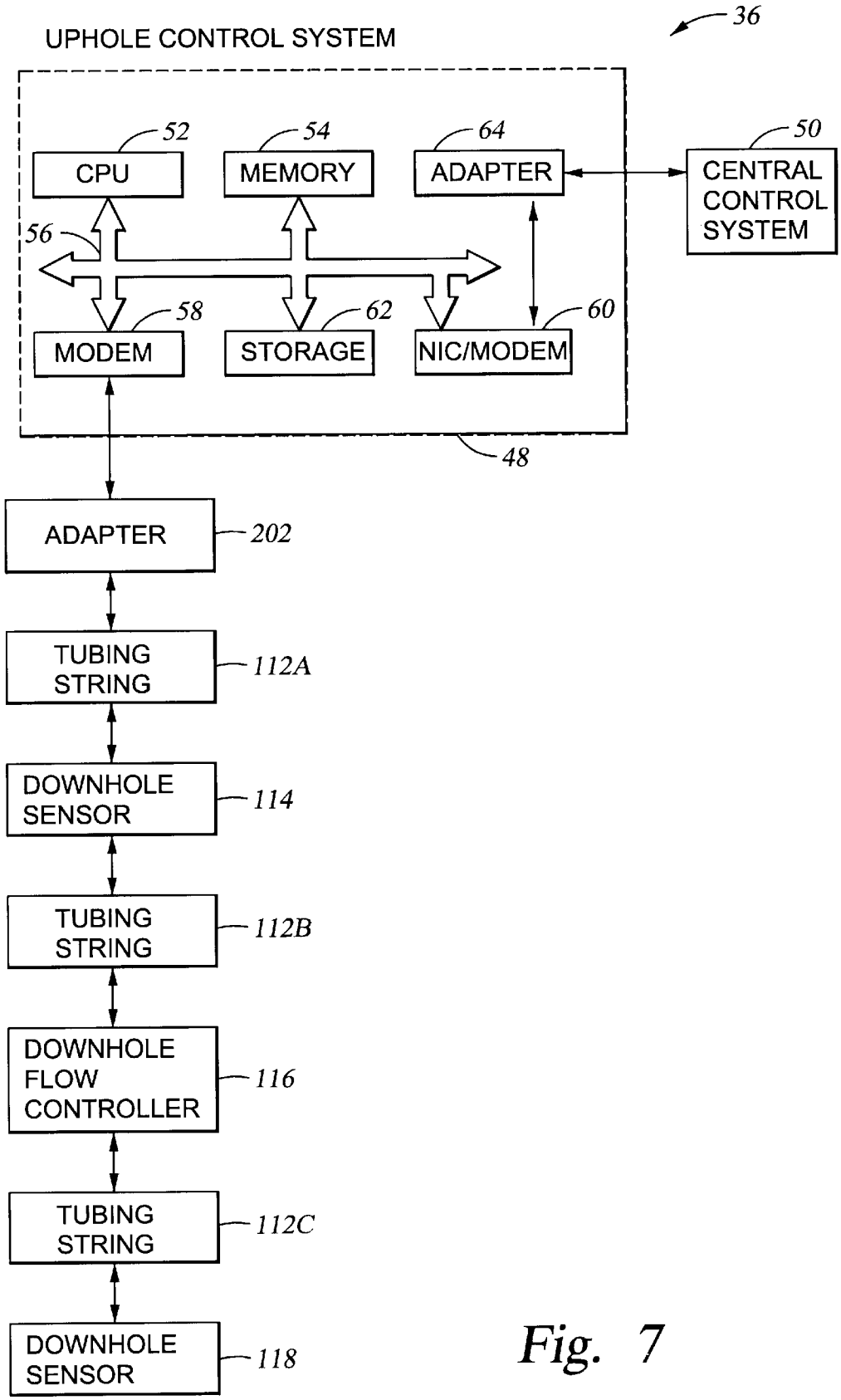
FIG. 7 is a block diagram of the intelligent completion system of FIG. 6 illustrating the connection of the components of the system.

Referring now to FIG. 7, there is shown a block diagram of intelligent completion system 100 with surface control system 36 for either manually or automatically monitoring and controlling the well 102. The "intelligent" continuous tubing string 112 connects downhole sensors 114, 118 and downhole flow controller 116 with surface control system 36. The surface control system 36 interfaces to the continuous tubing string 112A–112C via an adapter 202. Continuous tubing string 112 has mounted on it various downhole modules such as downhole sensors 114, 118 and downhole flow controller 116. Adapter 202 preferably provides impedance matching and driver circuitry for transmitting signals downhole, and preferably provides detection and amplification circuitry for receiving signals from downhole modules. Surface control system 36 has previously been described with respect to FIG. 2 and performs the remote acquisition, monitoring, processing, displaying and controlling of the intelligent completion system 100 either manually or automatically.

The following is an example of the operation of the intelligent completion system 100 in well 102. As shown, the two zones are produced together (i.e. the hydrocarbons flow into a common flowbore). The sensors in the modules 114, 118 monitor the flow of well fluids, containing hydrocarbons in the form of oil and gas, into the flowbore 124 of continuous tubing 112 sending the data to the surface 22 via conduits 40 preferably in the wall 44 of composite continuous tubing. The surface control system 36 processes the data to determine among other information the ratio of gas to oil in the well fluids. An increase in gas cut means that the ratio of gas to oil being produced in a formation has gone up. When that ratio gets too high, then oil is being left in the formation due to the high volume of gas being produced. If there is a substantial increase in the production of gas in one of the producing zones, then it may be desirable to reduce the flow of well fluids into the flowbore 124 of the continuous tubing 112 from that production zone or to close that production zone off altogether. In this manner, the gas production from a particular formation can be choked back or regulated. The control activation system 41 may be activated either manually or automatically to transmit a command signal through the conductor 40 in the wall 44 of the composite continuous tubing 112 downhole to activate one or more of the controls 116 to adjust the variable apertures in the controls 34 to reduce the flow of gas into the flowbore 124. The tool may take various configurations such as a movable sliding sleeve to restrict the flow ports through the tool and into the flowbore. It may also include decreasing the permeability of a screen which otherwise filters the producing fluids flowing into the flowbore.

Today with deviated wells, it is no longer assured that it will be the lowermost producing formation which is to be isolated. In a highly deviated well, the lowermost producing formation may be higher than an intervening producing formation. Use of the contemplated flow control devices in the disclosed embodiment allows the control of flow into the flowbore and through the flowbore. Control and management of the flow is particularly important into the flowbore (as distinguished with through the flowbore).

Figure 8:
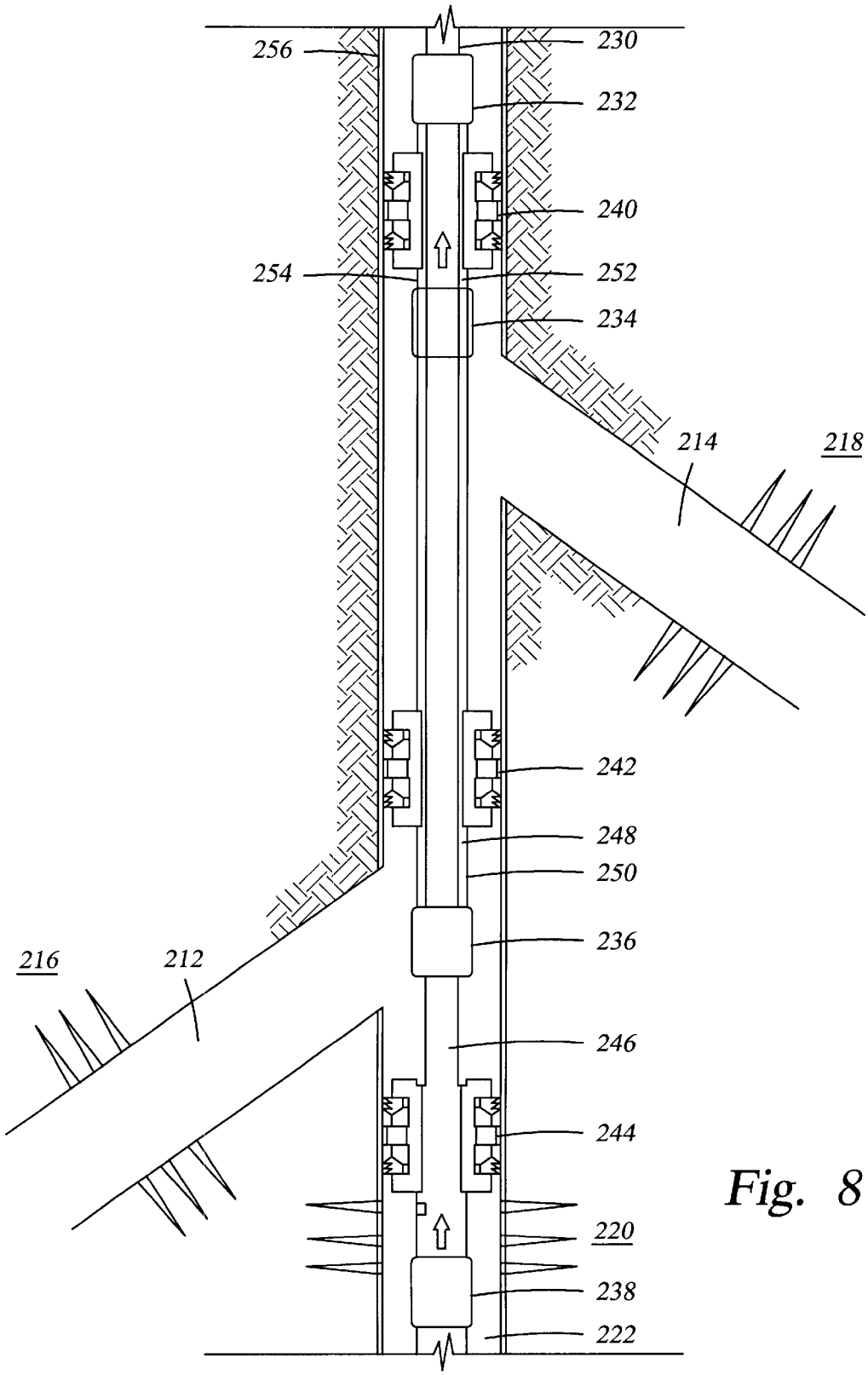
FIG. 8 is a schematic elevation view, partially in cross-section, of a well having one or more lateral boreholes from an existing well with another embodiment of the intelligent completion system of the present invention installed in the well.

Referring now to FIG. 8, there is shown another application of the present invention for the production of one or more lateral wells 212, 214 where the production from the individual production zones 216, 218, respectively, and the production from the production zone 220 of an existing well 222 is controlled and managed by the intelligent completion system. Packers 240, 242, and 244 separate the production from zone 218 of upper lateral well 214 from the production from zone 216 of lower lateral well 212 and from the production from zone 220 of existing well 222.

A continuous tubing string 230 extends from well head at the surface to various downhole modules 232, 234, 236, and 238 at selected locations adjacent the production zones. The continuous tubing string 230 is preferably composite continuous tubing. A tractor may be used to pull the intelligent completion system into position since the lateral wells 212, 214 may have horizontal boreholes. Continuous tubing string 230 utilizes conductors 38, 40 that communicate power and control signals from the surface control system 36 to the downhole modules. Surface control of these modules is thereby achieved without passing additional conduits or cables downhole. This is expected to significantly enhance the feasibility of a surface control reservoir analysis and management system. The downhole modules may be further configured to provide status and measurement signals to the surface via the conductors 38, 40.

The downhole modules 232, 234, 236, and 238 preferably include various sensors 32 for measuring downhole conditions while some of the modules preferably also include controls 34. The sensors 32 measure various parameters at every producing interval. This allows these parameters to be measured at each producing reservoir. Modules 234, 236, and 238, for example, may include both sensors 32 and controls 34 to monitor and regulate flow to the surface. Controls 34 preferably include variable apertures for controlling flow from the producing formation. Lowermost module 238 may include a multi-position valve to regulate or close off flow from zone 220 and into the flowbore 246 of continuous tubing 230 to enhance (or suppress) bubble formation in the hydrocarbons. Medial module 236 may also include a multi-position valve to regulate or close off flow from zone 216 and into annulus 248 formed by a sub 250 around tubing 230. Uppermost module 234 may include a multi-position valve to regulate or close off flow from zone 218 and into outer annulus 252 formed by a sub 254 around inner sub 250. Module 232 may include a multi-position valve for commingling the production from zones 220, 216, and 218 allowing the production to flow to the surface through annulus 256.

In the present invention, the well management system allows production through the multi-lateral wells 212, 214 while continuing to produce through the original production zone 220. The present invention also allows the control of production from each of the laterals 212, 214 as well as the main bore 222. As one of the wells begins to produce too much water, then the production from that zone may be choked back using one of the modules 234, 236, or 238. For other examples of controlling downhole production, see U.S. Pat. Nos. 5,706,896; 5,721,538; and 5,732,776, all hereby incorporated herein by reference.

Figure 9:
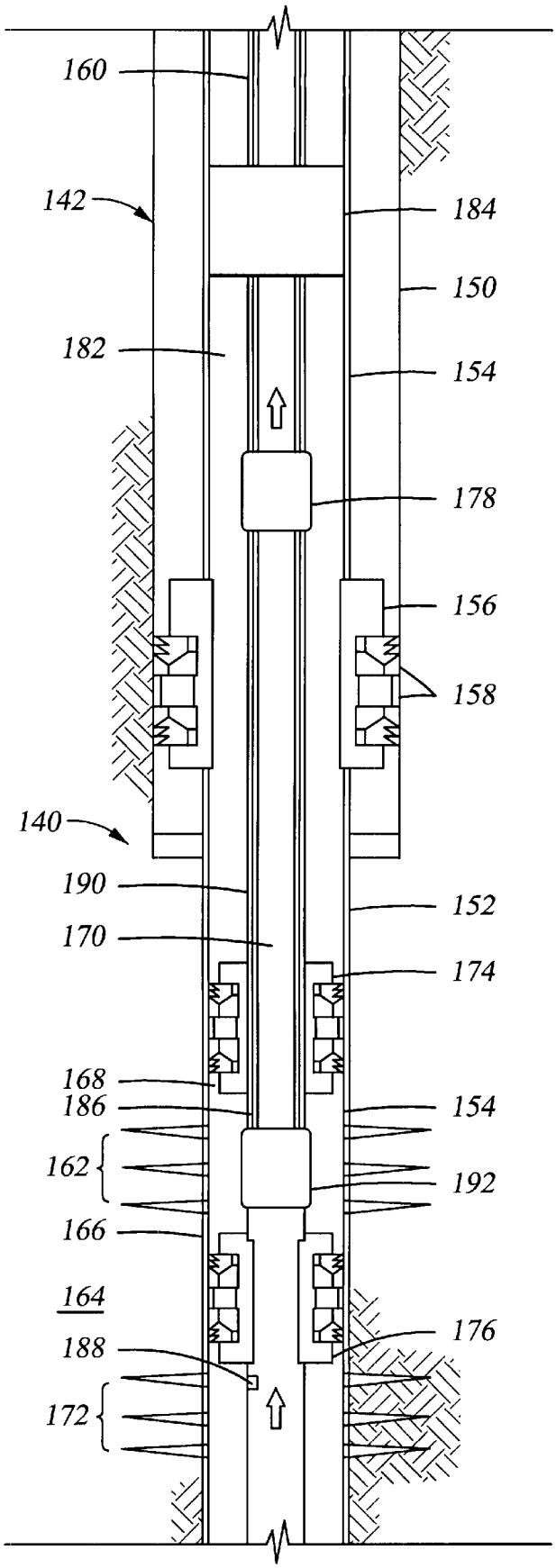
FIG. 9 is a schematic elevation view, partially in cross-section, of an existing well with still another embodiment of the intelligent completion system of the present invention for recompletion.

Referring now to FIG. 9, there is shown a well schematic illustrating the use of the intelligent completion system 140 for the workover or recompletion of an existing well 142. Existing well 142 includes a previously installed outer casing 150, a liner 152, and production tubing 154. Casing is defined as pipe which serves as the primary barrier to the formation. Production pipe is pipe which has been inserted inside the casing through which either the well is produced or fluids are pumped down. A liner does not extend to the surface and can be used either for production or as a barrier to the formation.

Liner 152 is supported within the well 142 by a packer hanger 156 which engages and seals at 158 with the inner wall of casing 150. The lower end of casing 150 is perforated forming perforations 162 in casing 150 to allow the flow of hydrocarbons from formation 164 into the flowbore of casing 150. The production tubing 154 includes apertures or typically a screen 166 allowing the flow of hydrocarbons into the flowbore 168 of production tubing 154. This is a monobore configuration since there is a single flowbore 168 from the perforations 162 to the surface. After the initial completion, there is production through perforations 162 in production tubing 154 and up through the flowbore 168 of the production tubing 154. However, at some point in the life of the well, the production from the formation 164 begins to drop off, possibly ecause the perforations 162 have become clogged, and well intervention or workover is squired to enhance production. For example, it may be desired to perforate a new set of perforations 172 to increase production. In the workover process a new interval may be perforated away from the old interval.

To perform the recompletion, intelligent completion system 140 is installed in existing well 142. A surface control system 36 and power supply 42, such as are shown in FIG. 1, are located at the surface 22. While the well 142 is live and producing, continuous tubing string 160 is lowered into the well through existing production tubing 154. The continuous tubing string 160 includes an upper packer 174 disposed and sealingly engaging the inner wall of the production tubing 154 above old perforations 162 and a lower packer 176 disposed and sealingly engaging the inner wall of the production tubing 154 between the old perforations 162 and the new perforations 172. Packers 174, 176 isolate the old perforations 162. A flow sub 178 is disposed in continuous tubing string 160 above packer 174 to allow flow from the flowbore 170 of continuous tubing string 160 into the annulus 182 formed between production tubing 154 and continuous tubing string 160. Because the prior downhole safety valve had to be removed from production tubing 154 to install continuous tubing string 160, an annular safety valve 184 is disposed in the continuous tubing string 160 above the flow sub 178 to control flow up the annulus 182.

Sensors 186, 188 are disposed above and below packer 176 to monitor the production through perforations 162 and through perforations 172. By way of example, sensors 186, 188 may measure the flow of hydrocarbons and other well fluids from 164. Although it should be appreciated that sensors 186, 188 may be sensor subs, such as those described with respect to FIG. 1A, it is preferred that continuous tubing string 160 be composite continuous tubing, such as shown and described with respect to FIGS. 3 and 4, with sensors 186, 188 being housed in the wall 190 of the composite continuous tubing. Conduit 40 extends through the wall 190 of composite continuous tubing 160 for conveying communications between surface control system 36 and the sensors 186, 188.

Further, one or more controls 192 are disposed in continuous tubing string 160 together with flow sub 168. For example, control 192 may be a flow control device similar to that shown Lnd described with respect to FIG. 1A. A conduit 38 extends through the wall 190 of composite continuous tubing 160 connecting surface control system 36 with flow control 192 and flow sub 178. Conduit 38 may provide both power and communication with surface control system 36.

Production then occurs through both perforations 162, 172 into the flowbore of production tubing 154 above and below packer 176. Flow from perforations 162 passes adjacent sensor 186 and through flow control 192 and flow from perforations 172 passes adjacent sensor 188 and into the flowbore 170 of composite continuous tubing 160. The commingled flow flows to the surface through flowbore 170 and may also flow through annulus 182 via flow sub 178.

The data acquisition system 37 of surface control system 36 receives data from the sensors 186, 188 and data processing system 39 processes that data to determine the flow from perforations 162, 172. If the downhole information indicates that flow through flow sub 178 should be adjusted, then controls activation system 41 may be activated either manually or automatically to send a command downhole to adjust the apertures in flow sub 178. Further if the information indicates that flow through perforations 162 should adjusted with respect to flow through perforations 172, then controls activation system 41 may be activated either manually or automatically to send a command downhole to adjust the variable apertures in flow control 192. Flow control 192 and flow sub 178 are preferably controlled from the surface. Thus, the flow rate from the two producing zones may be controlled from the surface 22. It should also be appreciated that packers 174, 176 may also be set and released by the surface control system 36. The power to set and release the packers 174, 176 could come through the wall 190 of the composite continuous tubing 160. Further, downhole safety valve 184 could also be controlled by the surface control system 36.

Figure 10:
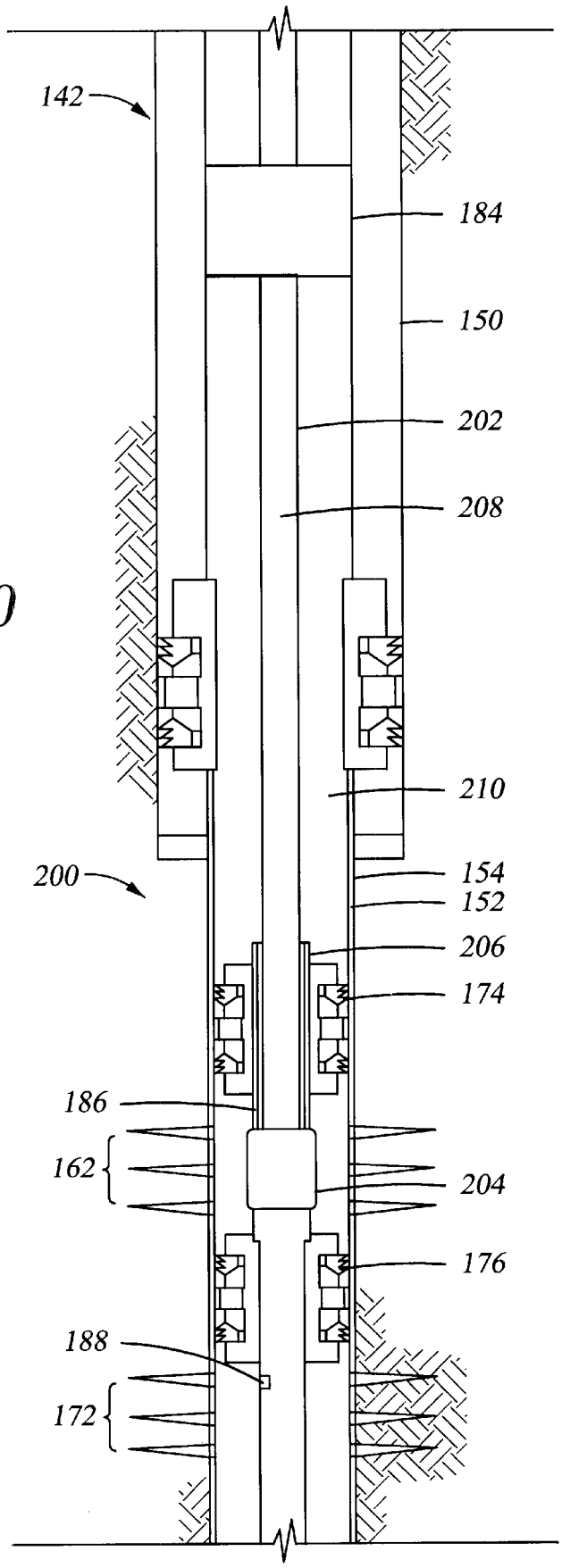
FIG. 10 is a schematic elevation view, partially in cross-section, of an existing well with yet another embodiment of the intelligent completion system of the present invention for recompletion using the flowbore of the continuous tubing for hydraulic control from the surface.

Referring now to FIG. 10, there is shown another embodiment of the intelligent completion system of FIG. 9. Like reference numerals have been used for like members described with respect to FIG. 9. To perform the recompletion of FIG. 10, intelligent completion system 200 is installed in existing well 142. While the well 142 is live and producing, continuous tubing string 202 is lowered into the well through existing production tubing 154. The continuous tubing string 202 includes an upper packer 174 and a lower packer 176 for isolating new perforations 162 from new perforations 172.

Sensors 186, 188 monitor the production through perforations 162 and through perforations 172. Conduit 40 extends through the wall of composite continuous tubing 202 for conveying communications between the data acquisition system 37 of surface control system 36 and the sensors 186, 188.

One or more controls 204 are disposed in continuous tubing string 202 together with flow sub 206 extending through or a part of upper packer 174. As distinguished from the embodiment of FIG. 9, control 204 is hydraulically controlled from the surface through the flowbore 208 of continuous tubing string 202. Pressure is applied down continuous tubing string 202 to actuate control 204. Thus internal hydraulic power is used for controlling control 204.

The data acquisition system 37 of surface control system 36 receives data from the sensors 186, 188 and the data processing system 39 processes that data to determine the flow from perforations 162, 172. If the downhole information indicates that flow through control 204 should be adjusted, then hydraulic pressure is applied down continuous tubing 202 to control 204 to adjust the variable apertures in flow control 204. Thus, the flow rate from the two producing zones may be controlled from the surface 22. As shown production flows through flow sub 206 into the annulus 210 formed between the continuous tubing 202 and the liner 152 and casing 150. The annulus 210 provides adequate flow area since continuous tubing 202 may have a reduced diameter as compared to continuous tubing 190 of FIG. 9. It should be appreciated that in the embodiment of FIG. 10, the electrical and data transmission conductors need not be disposed in the wall of the continuous tubing 202 but may extend through the flow bore of continuous tubing 202 since there is no production through flowbore 208 and no tools need pass through flowbore 208.

The intelligent completion system has advantages over a conventional intelligent recompletion of the well since a conventional recompletion requires that the completion be pulled. The present invention can be installed without substantially removing the previous completion. In the present invention, since it is a monobore well, new perforations can be perforated in the well interval and the production tubing allowed to remain in place. In some situations the recompletion of the present embodiment can be performed while the well is alive and producing, and it provides a planned method of increasing the production efficiency of the producing reservoir over time.

The present invention includes a intelligent completion that uses continuous tubing and preferably a composite continuous tubing by pulling a minimum number of pieces of the existing down hole completion equipment and particularly without pulling the production tubing. Further the intelligent completion system may be removed with relative ease because the production tubing does not have to be pulled.

The downhole controls are separately and individually controlled. Similarly, sensors are provided for separately monitoring each of the producing intervals. A specific control may be activated from the surface and the surface control system can then verify that that control has in fact been actuated. Whenever a control has to do more than just open or close, it may be difficult to determine whether the control was actuated. Also, it may be important to know the status at any time of any control in the well. Consequently, each of the controls preferably includes a feedback verification system to sense the control setting status and provide that information to the surface. Sensors are provided for both control feedback while other sensors monitor well or reservoir conditions.

Sensors and controls can share power and communication paths, so it is not necessary to have an individual control loop for each downhole control. Multiple controls can share an optical fiber, hydraulic conduit, or pair of electrical conductors through use of one or more multiplexing techniques (e.g. time-division multiplexing, frequency division multiplexing, and code-division multiplexing). These multiplexing techniques also allow power and communications signals to be carried across shared lines.

In some configurations, the downhole sensors may be sufficiently sensitive to provide verification that the control has operated properly in response to a command from the surface. However, the primary purpose of some sensors is for system feedback and verification. That is, some sensors are used to determine if a particular corrective action produces the desired result. This feedback loop will thus be able to assure the operator that the downhole resources are being properly managed. Intelligent completion systems will consequently use feedback control to optimize well production.

Governmental authorities often wish to know how much oil and gas is produced by particular intervals. Intelligent completion systems will be able to measure this information while the well is actively producing, i.e. it is not necessary to interrupt production to perform data-gathering tests. To accurately measure the production from a particular formation, it is necessary to know not only the pressure and overall flow rate but also the flow rates of both the gas and the oil. This information will allow the determination of how much oil and gas are each being produced on a particular formation.

It should be appreciated that a intelligent completion system may be provided for each producing interval. That is, a surface control system, continuous tubing string, and set of downhole modules may be provided for each producing interval downhole. This allows a finer spacing of sensors and controls. For example, the sensors may be located at 50 or 100 meter intervals. Such a configuration allows finer control of downhole conditions. It is expected that such a configuration allows portions of a producing interval to be closed if, for example, the interval is producing water or too much gas.

Through the use of the intelligent completion system of the present invention the well may be broken down into management blocks. Sensors and associated controls may be disposed at each management control point downhole in the well. It may be preferred that there be a sensor instead of a control for each producing interval. Also, if there is a large producing interval, it may be desirable to employ a plurality of sensors for that interval. Further, it may be desirable to strategically locate the sensors adjacent the producing interval such as having one sensor located near the top of the interval and another sensor located near the bottom of the interval. Each intelligent completion system is preferably designed for the particular well involved.

Although the intelligent completion system of the present invention is particularly applicable to multi-producing zones such as for producing two separate producing zones or for adding new perforations above or below an existing set of perforations, the present invention may also be used in a well with only one producing zone. It has the advantage of taking measurements down hole, accessing those measurements at the surface, processing the data and then either manually or automatically activating a command for controlling the well down hole rather than doing so at the surface. In field development there are advantages of having the data and control at the source of the hydrocarbons. This may be particularly applicable to a field concept with injection wells and producing wells which can then be changed during the life of the field.

It should also be appreciated that although the present invention has been described for use with a producing well, the present invention can also be used with an injection well.

Numerous variations and modifications will become apparent to those skilled in the art once the above disclosure is fully appreciated. It is intended that the following claims be interpreted to embrace all such variations and modifications.

What is claimed is:

1. A system for managing a well comprising:

a sensor disposed within the well;

a control disposed within the well;

a surface control system at the surface;

a composite tubing string extending into the well;

at least one signal conductor and at least one power conductor disposed within a wall of said composite tubing string;

said signal conductor connecting said sensor and said control with said surface control system; and said power conductor connecting a power supply at the surface with said control.

2. The system of claim 1 wherein said signal conductor transmits signals between said sensor, control and surface control system.

3. The system of claim 1 wherein said signal conductor is an optical fiber.

4. The system of claim 1 further including a hydraulic line extending from the surface downhole to said control.

5. The system of claim 1 wherein said control is from the group of: valve, sliding sleeve, choke, filter, packer, plug, regulator, suppressor, bubbler, heater, artificial lift, or pump.

6. The system of claim 1 wherein said control includes a transmitter adapted to send signals to said surface control system via said signal conductor indicating a current setting of said control.

7. The system of claim 1 wherein said sensor measures a downhole parameter and sends signals to said surface control system indicating the measurement of the parameter.

8. The system of claim 1 wherein said sensor is from the group of: flow meter, densitometer, pressure gauge, spectral analyzer, seismic device, and hydrophone.

9. The system of claim 1 wherein said sensor is housed within a wall of said composite tubing.

10. The system of claim 1 wherein said surface control system processes data from said sensor and sends commands to said control in response to the data.

11. The system of claim 1 wherein said surface control system determines a desired setting of the control to optimize production from the well.

12. The system of claim 1, further including a plurality of additional sensors wherein said surface control system processes data from said additional sensors to determine a desired setting for said control.

13. The system of claim 12, further including a plurality of additional controls wherein said surface control system directs said additional controls in response to the data received from said additional sensors.

14. The system of claim 1 wherein said surface control system includes:

a modem for receiving and transmitting signals via said conductor;

an information storage module coupled to said modem and configured to store received downhole data from said sensor;

a computer coupled to said information storage module and to said modem; and said computer sending commands to said modem for transmission downhole to said control.

15. The system of claim 14 wherein said surface control system further includes a network interface module that provides communication with a central control system.

16. The system of claim 1 wherein said sensor is disposed in the form of a sensor module on said composite tubing string.

17. The system of claim 1 wherein said signal conductor provides two-way communication between said surface control system and said sensor and control.

18. The system of claim 1 wherein said surface control system is programmed.

19. The system of claim 1 wherein said surface control system is automated.

20. The system of claim 1 wherein said surface control system allows manual intervention.

21. The system of claim 1 wherein said surface control system includes a data acquisition system, a data processing system, and a controls activation system.

22. The system of claim 21 including a sealing process to seal the well as the pair of conduits is lowered into the well.

23. A system for managing a well comprising:

a string of composite tubing extending into the well;

at least one sensor disposed within a wall of said composite tubing downhole within the well;

at least one control disposed on said string downhole within the well;

a processor at the surface;

an energy conductor disposed in said wall providing power to said control; and at least one data conductor disposed within said wall and connecting said sensor and said control with said processor.

24. An assembly for the workover of a well through a production pipe, comprising:

a continuous tubing string extending into the well through the production pipe;

a sensor disposed within the well adjacent the formation;

a control disposed within the well adjacent the formation;

a processor at the surface;

an energy conductor and a data conductor disposed on said continuous tubing string;

said data conductor connecting said sensor to said processor; and said energy conductor connecting said control to a source of energy at the surface.

25. The assembly of claim 24 further including another conductor disposed within the well and a power supply at the surface, said another conductor connecting said power supply to said control.

26. The assembly of claim 24 wherein said conductor transmits signals between said sensor, control and surface control system.

27. The assembly of claim 24 wherein said conductor is an optical fiber.

28. The assembly of claim 24 wherein said another conductor is a hydraulic line.

29. The assembly of claim 24 wherein said control is from the group of: valve, sliding sleeve, choke, filter, packer, plug, or pump.

30. The assembly of claim 24 wherein said control includes said sensor sending signals to said surface control system via said conductor indicating a current setting of said control.

31. The assembly of claim 24 wherein said sensor measures a downhole parameter and sends signals to said surface control system indicating the measurement of the parameter.

32. The assembly of claim 24 wherein said sensor is from the group of: flow meter, densitometer, pressure gauge, spectral analyzer, seismic device, and hydrophone.

33. The assembly of claim 24 wherein said continuous tubing string is a string of composite tubing.

34. The assembly of claim 24 wherein said conductor is housed within a wall of said composite tubing.

35. The assembly of claim 24 wherein said sensor is housed within a wall of said composite tubing.

36. The assembly of claim 24 wherein said surface control system processes data from said sensor and sends commands to said control in response to the data.

37. The assembly of claim 24 wherein said surface control system determines a desired setting of the control to optimize production from the well.

38. The assembly of claim 24, further including a plurality of additional sensors wherein said surface control system processes data from said additional sensors to determine a desired setting for said control.

39. The assembly of claim 38, further including a plurality of additional controls wherein said surface control system directs said additional controls in response to the data received from said additional sensors.

40. The assembly of claim 24 wherein said surface control system includes:

a modem for receiving and transmitting signals via said conductor;

an information storage module coupled to said modem and configured to store received downhole data from said sensor;

a computer coupled to said information storage module and to said modem; and said computer sending commands to said modem for transmission downhole to said control.

41. The assembly of claim 40 wherein said surface control system further includes a network interface module that provides communication with a central control system.

42. The system of claim 24 wherein said continuous tubing string includes a liner disposed inside an outer tubing with said conductors housed between said liner and outer tubing.

43. The system of claim 24 wherein said continuous tubing string includes dual wall pipe with one pipe housed within another pipe with said conductors being disposed between said pipes.

44. The system of claim 24 wherein said continuous tubing string includes a plurality of inner pipes within an outer pipe.

45. The system of claim 24 wherein said continuous tubing string includes attaching two tubing strings together and lowering them into the well.

46. A method for controlling production in a well, comprising:

receiving well information from a sensor disposed downhole via a conductor disposed on a continuous tubing string extending into the well;

processing the well information by a processor at the surface to determine a preferred setting for a control disposed downhole in the well; and transmitting signals and power to the control via an energy conductor disposed within a wall of the continuous tubing string.

47. The method of claim 46 further comprising adjusting the control in response to the transmitted signals.

48. The method of claim 47 further comprising transmitting a verification signal from the control to the processor via the energy conductor.

49. The method of claim 46 further comprising generating flow information by the sensor and commanding the control to alter the flow of the production.

50. A method for controlling production in an existing well having an existing production tubing extending into the existing well comprising:

extending a continuous tubing string through the existing production tubing;

receiving well information from a sensor disposed downhole on the continuous tubing string via a conductor extending from the sensor to the surface;

processing the well information at the surface to determine a preferred setting for a control disposed downhole in the well; and transmitting signals and power to the control via an energy conductor disposed on the continuous tubing string.

51. A system for managing first and second production zones comprising:

first and second sensors disposed adjacent the first and second production zones, respectively;

first and second controls disposed adjacent the first and second production zones, respectively;

a surface control system at the surface;

a composite tubing string extending into the well;

at least one signal conductor and at least one power conductor disposed within a wall of said composite tubing string;

said signal conductor connecting said first and second sensors and controls with said surface control system; and said power conductor connecting a power supply at the surface with said first and second controls.

52. A system for managing a horizontal well comprising:

a composite tubing string extending into the horizontal well and having a propulsion system disposed adjacent a downhole end of said composite tubing string;

a sensor disposed downhole on said composite tubing string;

a control disposed on said composite tubing string in the horizontal well;

a surface control system at the surface;

at least one signal conductor and at least one power conductor disposed within a wall of said composite tubing string;

said signal conductor connecting said sensor and said control with said surface control system; and said power conductor connecting a power supply at the surface with said control.

53. A system for managing flow from a lateral well and an existing well comprising:

a first sensor disposed within the flow from the existing well and a second sensor disposed within the flow from the lateral well;

a first control disposed within the flow from the existing well and a second control disposed within the flow from the lateral well;

a surface control system at the surface;

a composite tubing string extending into the existing well;

at least one signal conductor and at least one power conductor disposed within a wall of said composite tubing string;

said signal conductor connecting said first and second sensors and controls with said surface control system; and said power conductor connecting a power supply at the surface with said first and second controls.

54. A system for the workover of an existing well through the existing production tubing extending into the existing well comprising:

a composite tubing string extending through the existing production tubing;

a sensor disposed within the existing production tubing downhole on said composite tubing string;

a control disposed within the existing production tubing downhole on said composite tubing string;

a surface control system at the surface;

at least one signal conductor and at least one power conductor disposed within a wall of said composite tubing string;

said signal conductor connecting said sensor and said control with said surface control system; and said power conductor connecting a power supply at the surface with said control.

55. A system for the workover of a live and producing well through the existing production tubing extending through first and second producing formations, the first producing formation being isolated from the second producing formation comprising:

a continuous tubing string extending through the existing production tubing;

a first sensor disposed on said continuous tubing string adjacent the first producing formation and a second sensor disposed on said continuous tubing string adjacent the second producing formation;

a control disposed on said continuous tubing string adjacent the first producing formation and upstream of the second producing formation;

a surface control system at the surface;

at least one signal conductor extending from said surface control system to said sensors;

at least one power conductor extending from said surface control system to said control;

said signal conductor connecting said sensor and said control with said surface control system; and said power conductor connecting a power supply at the surface with said control.

56. A system for the workover of a live and producing well through the existing production tubing extending through first and second producing formations, the first producing formation being isolated from the second producing formation comprising:

a continuous tubing string extending through the existing production tubing;

a first sensor disposed on said continuous tubing string adjacent the first producing formation and a second sensor disposed on said continuous tubing string adjacent the second producing formation;

a control disposed on said continuous tubing string adjacent the first producing formation and upstream of the second producing formation;

a surface control system at the surface;

at least one signal conductor extending from said surface control system to said sensors;

said control being hydraulically controlled from the surface through the continuous tubing string.

57. A method for controlling production in a well, comprising:

gathering downhole data from sensors disposed downhole via a conductor disposed on a continuous tubing string extending into the well;

processing said downhole data by a data processing system of a surface control system to determine downhole operating conditions; and adjusting downhole controls by transmitting signals and power to the control via an energy conductor disposed within a wall of the continuous tubing string.

58. The method of claim 57 further including checking the system configuration using said surface control system.

59. The method of claim 58 wherein said surface control system includes a survey of all downhole components to verify their status and functionality.

60. The method of claim 58 wherein said surface control system includes a verification of the communications link to a central control system.

61. The method of claim 58 wherein said surface control system includes checking of the functionality of various components of said surface control system.

62. The method of claim 58 wherein said surface control system includes checking for the existence of configuration updates from a central control system.

63. The method of claim 58 wherein said surface control system includes checking for currency of backup and log information.

64. The method of claim 58 wherein said surface control system includes verifying the validity of a recent log data stored in long-term information storage.

65. The method of claim 57 further including determining desired control settings for downhole devices using said surface control system.

66. The method of claim 57 further including comparing said downhole operating conditions with said desired control settings.

* * * * *